US005900894A

United States Patent [19]

Koizumi et al.

[11] Patent Number: 5,900,894

[45] Date of Patent: May 4, 1999

[54] INK JET PRINT HEAD, METHOD FOR MANUFACTURING THE SAME, AND INK JET RECORDING DEVICE

[75] Inventors: Yukihisa Koizumi; Masahiko Fujii; Jun Takagi; Nobuo Kenmotsu; Masaki Kataoka; Masayoshi Tamai, all of Ebina, Japan

[73] Assignee: Fuji Xerox Co., Ltd., Tokyo, Japan

[21] Appl. No.: 08/826,663

[22] Filed: Apr. 7, 1997

[30] Foreign Application Priority Data

Apr. 8, 1996 [JP] Japan ..... 8-084911
Feb. 27, 1997 [JP] Japan ..... 9-043669

[51] Int. Cl.[6] ..... B41J 2/05; B41J 2/175

[52] U.S. Cl. ..... 347/65; 347/85

[58] Field of Search ..... 347/65, 63, 86, 347/87, 85

[56] References Cited

U.S. PATENT DOCUMENTS

| | | | |
|---|---|---|---|
| 4,490,728 | 12/1984 | Vaught et al. | 347/60 |
| 4,528,577 | 7/1985 | Cloutier et al. | 347/63 X |
| 4,558,333 | 12/1985 | Sugitani et al. | 347/65 |
| 4,611,219 | 9/1986 | Sugitani | 347/65 X |
| 4,794,411 | 12/1988 | Taub et al. | 347/47 |
| 5,148,185 | 9/1992 | Abe | 347/65 |
| 5,208,604 | 5/1993 | Watanabe et al. | 347/47 |
| 5,291,226 | 3/1994 | Schantz et al. | 347/65 X |
| 5,378,137 | 1/1995 | Asakawa et al. | 425/174.4 |
| 5,455,613 | 10/1995 | Canfield et al. | 347/65 |
| 5,574,488 | 11/1996 | Tamura | 347/63 |
| 5,751,323 | 5/1998 | Swanson | 347/87 |

FOREIGN PATENT DOCUMENTS

| | | | |
|---|---|---|---|
| A 55-59975 | 5/1980 | Japan | B41J 3/04 |
| A 55-100169 | 7/1980 | Japan | B41J 3/04 |
| A 60-204352 | 10/1985 | Japan | B41J 3/04 |
| A 60-206653 | 10/1985 | Japan | B41J 3/04 |
| A 61-230954 | 10/1986 | Japan | B41J 3/04 |
| B2 63-6356 | 2/1988 | Japan | B41J 3/04 |
| A 63-183855 | 7/1988 | Japan | B41J 3/04 |
| A 2-121843 | 5/1990 | Japan | B41J 2/16 |
| A 4-118247 | 4/1992 | Japan | B41J 2/05 |
| A 5-31898 | 2/1993 | Japan | B41J 2/05 |
| A 6-8434 | 1/1994 | Japan | B41J 2/05 |
| A 6-8472 | 1/1994 | Japan | B41J 2/175 |
| B2 6-4320 | 1/1994 | Japan | B41J 2/045 |
| A 6-79874 | 3/1994 | Japan | B41J 2/135 |
| A 6-328699 | 11/1994 | Japan | B41J 2/135 |
| B2 6-98758 | 12/1994 | Japan | B41J 2/05 |
| B2 6-98763 | 12/1994 | Japan | B41J 2/05 |
| A 7-1739 | 1/1995 | Japan | B41J 2/16 |
| B2 7-29437 | 4/1995 | Japan | B41J 2/05 |
| A 7-112097 | 5/1995 | Japan | D06F 58/28 |
| A 7-144418 | 6/1995 | Japan | B41J 2/175 |
| A 7-223316 | 8/1995 | Japan | B41J 2/045 |
| A 77-232433 | 9/1995 | Japan | B41J 2/05 |
| A 8-267098 | 10/1996 | Japan | C02F 11/00 |

*Primary Examiner*—Joseph Hartary
*Attorney, Agent, or Firm*—Oliff & Berridge, PLC

[57] ABSTRACT

An ink jet print head is disclosed which comprises: a head chip having a plurality of heating elements thereon, a flow passage forming member including a plurality of injection ports respectively corresponding to the heating elements for jetting out ink, a substrate for fixing the head chip, and a joint for supplying ink, wherein the substrate includes an opening so formed as to extend in the arrangement direction of the heating elements, the flow passage forming member is disposed so as to cover the opening from a position above the head chip, at least part of the joint is connected to the flow passage forming member, and ink supplied from the joint is supplied along the flow passage forming member to the heating elements disposed on the head chip.

40 Claims, 17 Drawing Sheets

INK JET PRINT HEAD, METHOD FOR MANUFACTURING THE SAME, AND INK JET RECORDING DEVICE

BACKGROUND OF THE INVENTION

The present invention relates to an ink jet print head of a thermal type that air bubbles are produced in ink due to the heat that is generated by a heating element and the ink is jetted out due to the pressure of the thus produced air bubbles, thereby carrying out recording.

Conventionally, as an ink jet print head of a thermal type, there have been developed a side shooter type and a roof shooter type. The ink jet print head of a side shootor type is a head of a type that a heating element is disposed in the intermediate portion of an ink flow passage and ink is jetted out in a direction parallel to the surface of the heating element. With use of the print head of a side shooter type, for example, as shown in the Unexamined Japanese Patent Application Publication No. Sho 61-230954, the Examined Japanese Patent Application Publication No. Hei 6-98758, the Examined Japanese Patent Application Publication No. Hei 6-98763, and the like, an anisotropic etching is enforced in a Si substrate to thereby be able to form an injection port for ink. That is, a side shooter type is suitable for a high-density print head.

On the other hand, the print head of a roof shooter type is structured such that ink is jetted out. from an injection port, which is formed in a surface opposed to the surface of a heating element, in a direction at right angles to the surface of the heating element. The print head having this structure is disclosed in the Examined Japanese Patent Application Publication No. Hei 6-4320, the Examined Japanese Patent Application Publication No. Hei 7-29437, the Unexamined Japanese Patent Application Publication No. Hei 6-79874, and the like. According to this type of print head, a high injection efficiency can be obtained, the print head can he driven at high frequencies, and a strong injection force can be provided. On the other hand, however, the print head of a roof shooter type is disadvantageous in that it is unable to provide a highly dense arrangement of the injection ports per line. For this reason, the injection ports are arranged in a plurality of lines in order to be able to enhance the recording density thereof.

Further, as disclosed in the Examined Japanese Patent Application Publication No. Sho 63-6356, the Unexamined Japanese Patent Application Publication No. Sho 55-59975, and the like, there is also known another structure in which a heating element is disposed in the intermediate portion of an ink slow passage as in the print head of a side shooter type and the surface of the heating element is directed toward ink injection ports as in the print head of a roof shooter type.

As an example of the ink jet print head of a roof shooter type, for instance, in the Unexamined Japanese Patent Application Publication No. Hei 6-79874, there is disclosed a structure in which a tape member includes a member having an orifice and an ink flow passage. Also, in the Unexamined Japanese Patent Application Publication No. Hei 6-8434, there is disclosed a print head of a roof shooter type which is the same in structure as in the above publication and also which further includes a fluid channel structure for jetting out ink from an ink tank through the back, side and upper surfaces of a substrate carrying a heating element thereon. Further, in the Unexamined Japanese Patent Application Publication No. Hei 6-8472, there is disclosed a seal structure for a flow passage disclosed in the Unexamined Japanese Patent Application Publication No. Hei 6-8434 and, in an embodiment thereof, there is illustrated a flow passage structure in which tape having injection ports formed therein is connected to a barrier layer. Still further, in the specification of U.S. Pat. No. 4,794,411, there is disclosed a heating element which is formed square. Moreover, in the Unexamined Japanese Patent Application Publication No. Hei 7-1739, there is disclosed a method for manufacturing such ink jet print head.

However, in the above-mentioned conventional ink jet print heads, for example, when trying to realize a higher density such as 600 dpi or more, or when trying to enhance the drive frequencies of the individual channels and, at the same time, to increase the number of drive bits to thereby realize a higher speed, there arise the following problems. At first, the dimensions of the injection ports in the arrangement direction thereof are reduced so that the freedom of design of the injection ports is lowered, and it is difficult to secure the strength of the part in which the injection ports are formed. For example, in the structures as set forth in the above-mentioned publications, a photosensitive resin layer is used as an ink flow passage, while the ink flow passage, in particular, the ink flow side of the ink flow passage onto the heating element is reduced in size in the direction of arrangement of the injection ports in order to prevent the ink from flowing backward. Provision of such size reduction structure not only makes it difficult to secure a sufficient resolution for etching of the photosensitive resin, but also reduces the cross section of the flow-in side of the ink flow passage to thereby increase the resistance of the ink flow passage. Also, in the structure in which the ink supply passage is so formed as to extend around the back portion, end portion and upper portion of the substrate with the heating element carried thereon, If the injection ports are increased in number and the substrate is thereby extended in length, then the support of the back surface of the substrate is short, with the result that the substrate itself becomes weak in strength and thus it can be broken easily. Further, a distance from the heating element to the injection port is preferably about 100 $\mu$m or less from the viewpoint of a jetting performance and, in the above-mentioned publications as well, the distance is controlled down to about 75 $\mu$m because the injection ports are formed in the tape member. However, the tape member is short of strength as a component of the print head.

In order to enhance the strength of a component in which the injection ports are to be formed, for example, in the Examined Japanese Patent Application Publication No. Hei 6-4320 and FIGS. 10A and 11 of the specification of U.S. Pat. No. 4,490,728, there is disclosed a structure in which a rather thick plate is used and there are formed recessed portions in the ink injection port surfaces of the plate. However, in such structure in which the ink injection port surfaces are simply recessed suddenly, there arises a problem that, when the ink injection ports are wiped in maintenance, they cannot be cleaned up.

By the way, as a method for reducing the size of the ink flow passage on the ink flow-in side thereof onto the heating element, not in the print head of a roof shooter type but in the print head of a side shooter type, for example, as disclosed in the Unexamined Japanese Patent Application Publication No. Sho 55-100169 and the Unexamined Japanese Patent Application Publication No. Sho 60-204352, there is known a method in which a barrier layer is provided on the ink flow-in side of the ink flow passage so as to enhance the jetting performance of ink, or, as disclosed in the Unexamined Japanese Patent Application Publication No. Hei 7-232433, the Japanese Patent Application No. Hei 7-112097, and the like, there is known a method in which the cross section of an ink flow passage formed in a synthetic resin layer is reduced not only in the arrangement direction of injection ports but also in directions respectively at right angles to the arrangement direction of the injection ports and to the direction of flow of ink. On the other hand, in the print head of a roof shooter type, as disclosed in the specification of U.S. Pat. No. 4,558,333, there is known a structure in which heating elements are respectively separated by partition walls to thereby prevent the pressure from being propagated in other directions than the direction of the injection ports.

Further, as a structure of a roof shooter type, for example, there is known a structure in which the size of the ink flow passage is reduced in the arrangement direction of injection ports but, as disclosed in the specification of U.S. Pat. No. 5,455,613, a pressure chamber in which a heating element is formed is formed in a circular or elliptical shape. In this case as well, the resolution for etching the photosensitive resin cannot be enhanced. Still further, as disclosed in the Unexamined Japanese Patent Application Publication No. Hei 5-31898, there is known a structure in which no such size reduced portion is provided in an ink flow passage but a rectangular pressure chamber is, as it is, connected to a common ink flow passage. In this case, however, the pressure propagation to other directions than that of the injection ports cannot be avoided.

Now, referring to the structure of a nozzle, for example, as disclosed in the Unexamined Japanese Patent Application Publication No. Hei 6-328699 as well as in the before-mentioned Unexamined Japanese Patent Application Publication No. Hei 5-31898, there is known a structure in which the nozzle is tapered. However, in an ink jet print head disclosed in the Unexamined Japanese Patent Application Publication No. Hei 6-328699, similarly to the above-mentioned roof shooter type, some of nozzles are formed in tape member or the like so that such nozzles are lacking in strength from the viewpoint of the parts of an ink print head. Also, more preferably, the whole of the upper portion of the heating element may be tapered but it is impossible to provide such taper in the barrier layer.

Referring to the structure of an ink flow passage, there are known several structures for example, a structure in which an ink flow passage starts from the back side of a substrate with a heating element placed thereon, passes through the side portion thereof, and then arrives at the top surface thereof, as disclosed in the above-mentioned Unexamined Japanese Patent Application Publication No. Hei 6-8434; a structure in which there are opened up holes in a substrate and ink is supplied through the holes, that is, from both sides of a heating element onto the top surface of the heating element, as disclosed in the Unexamined Japanese Patent Application Publication No. Sho 60-206653; and, a structure in which there is opened up a hole between two heating elements, and ink is supplied from the hole and is diverged to two sides so that the ink can be supplied onto the respective top surfaces of the two heating elements. However, because the substrate on which the heating element is carried is hard, in the method to open up a hole in the substrate, it is not easy to machine the substrate to open up the hole in the substrate and also such machining operation inevitably has an ill effect on the substrate.

In a structure disclosed in the Unexaminied Japanese Patent Application Publication No. Sho 63-183855, a substrate on which two heating elements are placed is disposed on the two sides of an elliptic hole formed in a base member, that is, without opening up a hole in the substrate, there can be obtained a similar structure to the above-mentioned Unexamined Japanese Patent Application Publication No. Hei 7-144418. However, in such structure, similarly to the above-mentioned structure using the tape member, a sufficient strength cannot be secured for a member in which injection ports are formed. Also, when a metal plate formed of metal such as Al or the like is used as the base member, it gives an advantage to radiation of heat but, since the metal plate provides a flow passage for ink, it is exposed to the ink and is thereby easy to corrode.

Further, as illustrated in the above-mentioned Unexamined Japanese Patent Application Publication No. Hei 5-31898, there is proposed a structure in which an opening is formed in an ink tank cover, a head chip is fixed in such a manner that the head chip covers the opening, and a top plate is placed on the head chip. However, in this structure, because the head chip is not in contact with the metal plate formed of metal such as Al or the like, radiation of heat is poor, so that the performance and durability of the structure are poor. If the ink tank cover is formed of metal such as Al or the like, then good heat radiation can be provided but, because the ink tank cover is part of the ink tank, the ink tank cover is always in contact with ink, so that the ink tank cover can be corroded as described above.

Referring now to a method for manufacturing an ink jet print head using a similar technique to the prosent invention, for example, in the Unexamined Japanese Patent Publication No. Hei 7-223316, a nozzle plate blank material is injection molded and a nozzle is machined by us of laser. Also, in the Unexamined Japanese Patent Application Publication No. Hei 2-121843 and U.S. Pat. No. 5,208,604, after the outer shape of a top plate, individual flow passages and the like are formed by use of a resin mold, a nozzle is formed by use of laser. However, these techniques are used to manufacture an ink jet print head of a side shooter type, but not to manufacture an ink jet print head of a roof shooter type.

Now, according to the specification of U.S. Pat. No. 4,528,577, in an ink jet print head of a roof shooter type, an ink flow passage and a nozzle are formed in an orifice plate using an electro-forming method which is different from the method of the present invention. Also, according to the specification of U.S. Pat. No. 5,291,226, an ink flow passage and a nozzle are formed in a tape member by use of laser. The laser machining operation is truly able to machine such flow passage and nozzle with high precision but, disadvantageously, it takes much time to machine the whole shape of the flow passage and nozzle by laser. Further, in the above-mentioned Unexamined Japanese Patent Application Publication No. Hei 7-144418, the nozzle, flow passage and the like are formed in an integral manner. The integral formation does not require additional machining, whereas the integral formation has a limit to fine or minute machining.

SUMMARY OF THE INVENTION

The present invention aims at eliminating the drawbacks found in the above-mentioned conventional ink jet print heads. Accordingly, it is an object of the invention to provide an ink jet print head of a roof shooter type which permits the highly dense arrangement of injection ports, allows the respective components thereof to have a sufficient strength, can enjoy a long life, allows an easy wiping operation in maintenance, and can provide a high jetting efficiency and an excellent jetting property.

In attaining the above object, according to the invention, there is provided an ink jet print head in which a head chip is fixed onto a substrate and a flow passage forming member is so disposed as to extend from above the head chip to an area where the substrate is not existent. When an opening is formed in the substrate, the flow passage forming member is disposed in such a manner that it covers the opening of the substrate. A joint is connected to at least the flow passage forming member. In the present ink jet print head, the head chip is allowed to use the substrate as a heat radiating plate, at the same time, the heat radiating plate can also be structured in such a manner that it is free from contact with ink. Also, the other portions of the flow passage forming member than the portion thereof situated above the head chip can be formed such that they have a sufficient thickness. Further, the present ink jet print head can be manufactured simply by assembling together such small number of components.

DETAILED DESCRIPTION OF THE PREFERRED EMBODIMENTS

Figure 1:
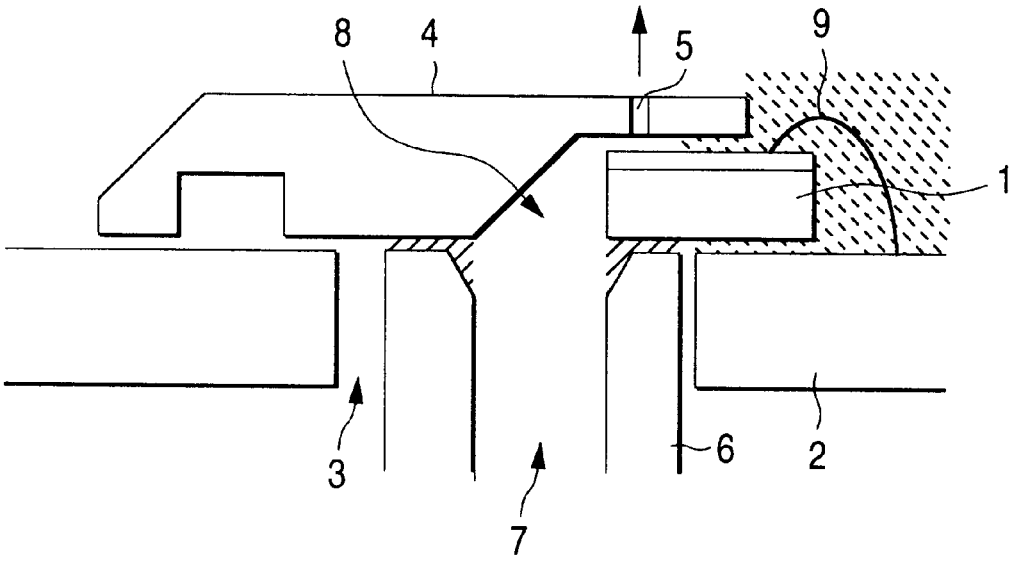
FIG. 1 is a section view of a first embodiment of an ink jet print head according to the invention.
Figure 2:
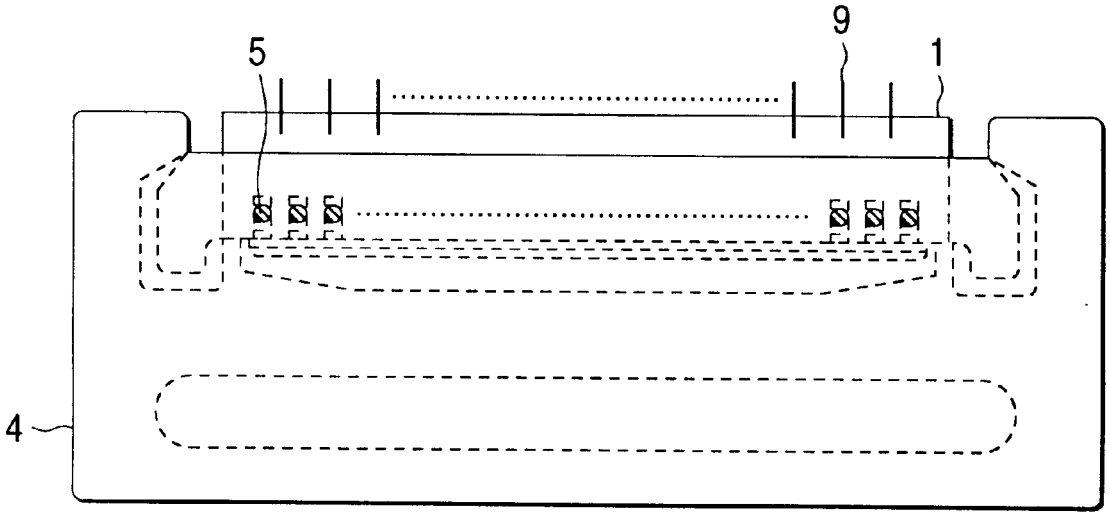
FIG. 2 is a plan view of the first embodiment of an ink jet print head according to the invention.
Figure 3:
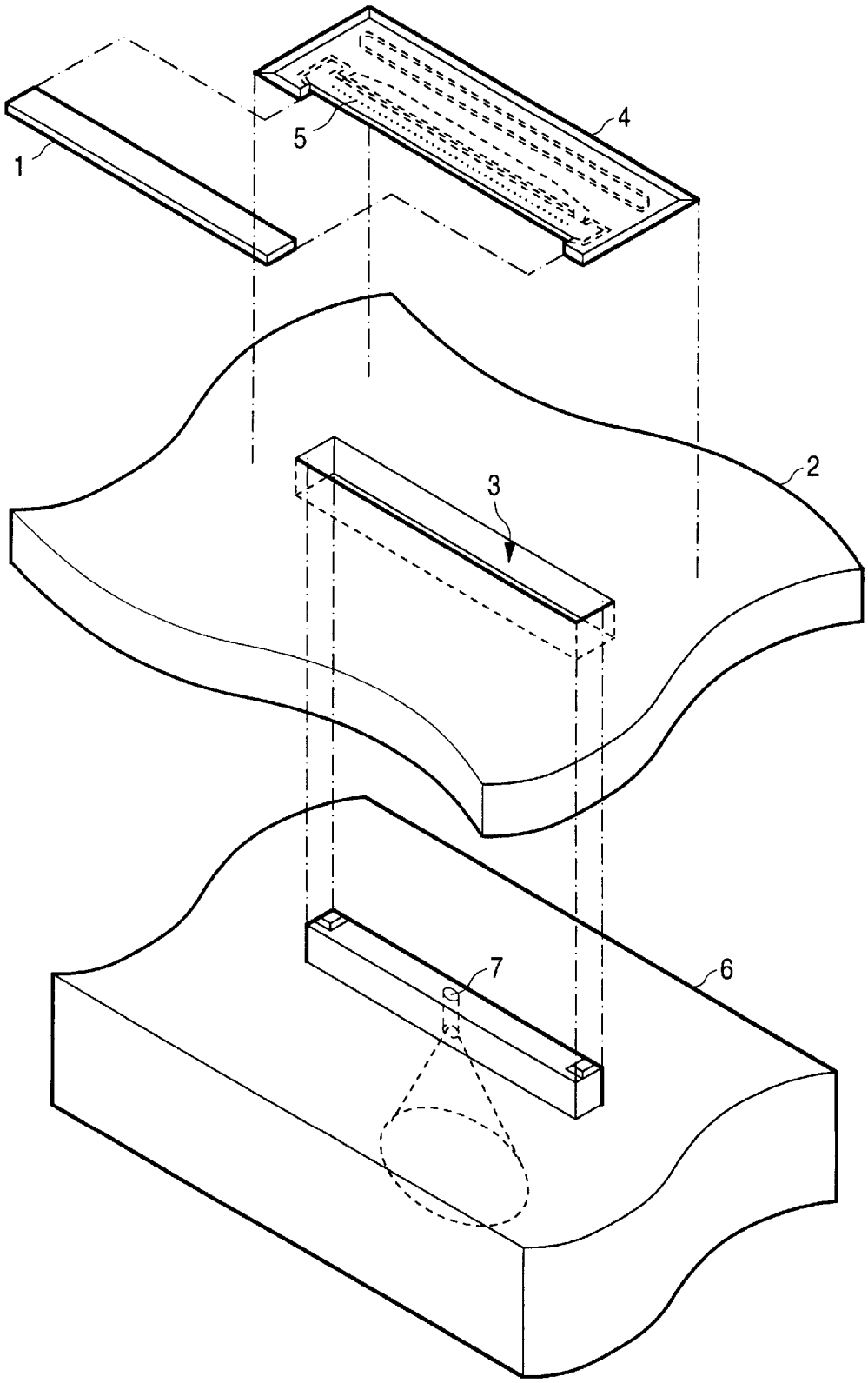
FIG. 3 is an exploded perspective view of the first embodiment of an ink jet print head according to the invention.
Figure 4:
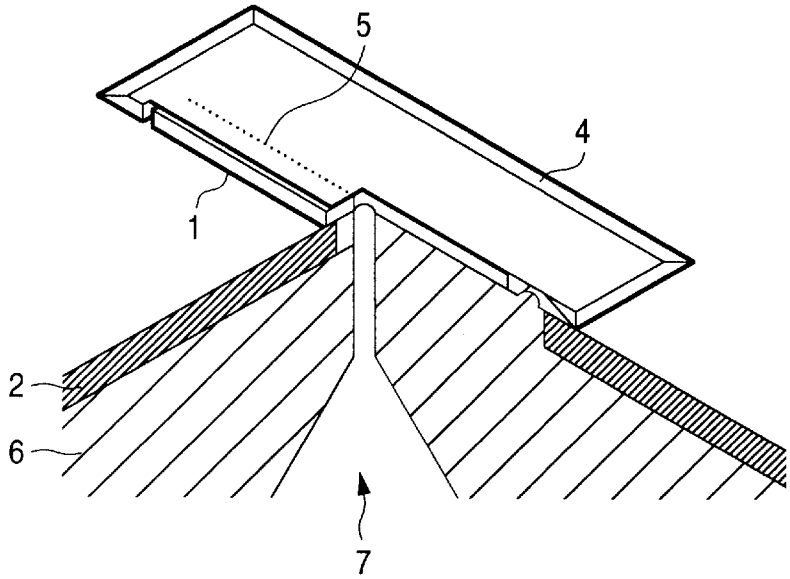
FIG. 4 is a partially broken perspective view of the first embodiment of an ink jet print head according to the invention.

Now, description will be given below in detail of the preferred embodiments of the invention with reference to the accompanying drawings. Firstly, FIG. 1 is a section view of a first embodiment of an ink jet print head according to the invention, FIG. 2 is a plan view of the first embodiment, FIG. 3 is an exploded perspective view of the first embodiment, and FIG. 4 is a partially broken perspective view of the first embodiment. In the drawings, reference character 1 designates a head chip, 2 a heat sink, 3 an opening, 4 a flow passage forming member, 5 injection ports, 6 a joint, 7 an ink supply pipe, 8 an ink supply chamber, and 9 a bonding wire, respectively.

The head chip 1 is composed of a Si substrate or the like and includes on the surface thereof a plurality heating elements, electric wires for driving the heating elements, and the like. Also, in some cases, a drive circuit used to drive the respective heating elements can be provided in the head chip 1. On the upper surface of the head chip 1, as a flattening layer or a protection layer, there is formed a thin resin film layer which is formed of photosensitive resin. The thickness of the resin film layer is of the order of 5 $\mu$m or less. The present resin film layer flattens surface differences caused by providing the heating elements and the drive circuit therefor on the head chip 1, improves the close contact of the head chip 1 with the flow passage forming member 4, and protects the heating elements, drive circuit, and wires against corrosion due to ink. If the head chip 1 is sufficiently flat and includes an ink resisting surface, then there is no need for provision of such resin film layer.

The heat sink 2 is a metal substrate which is formed of a highly thermally conductive material such as Al or the like. The head chip 1 is carried on this heat sink 2 by means of a highly thermally conductive adhesive formed of silver epoxy or the like in such a manner that the head chip 1 is in thermal contact with the heat sink 2. The heat sink 2 not only can maintain the strength of the chip head 1 but also can radiate properly the heat that is generated in the head chip 1 to thereby be able to eliminate inconveniences such as the overheat of the head chip and the like. Also, the heat sink 2 can keep the back surface side of the head chip 1 in an earth potential to thereby be able to assure the positive operation of a transistor circuit or the like provided in the chip head 1. Further, on the surface of the heat sink 2, there is arranged an electric wire which is used to connect a printer main body with the head chip 1, while the heat sing 2 is connected electrically with the head chip 1 by means of a bonding wire 9 or the like.

Still further, the heat sink 2 includes an opening 3 which is so formed as to extend in the arrangement direction of the injection ports 5. The joint 6 can be inserted through the opening 3. The head chip 1 is disposed such that the whole thereof is not connected to the heat sink 2 but covers the opening 3.

The flow passage forming member 4 is formed of resin or the like and is so disposed as to cover the opening 3. The flow passage forming member 4 also covers part of the upper portion of the head chip 1 and is alignment connected to or closely contacted with the head chip 1. The portion of the flow passage forming member 4 that is placed over the head chip 1 is formed thin in thickness. Also, in the flow passage forming member 4, there are formed openings, which are to be used as the injection ports 5, in such a manner that they are matched in position to the heating elements formed on the head chip 1. Except for the individual ink flow passages that respectively correspond to the heating elements, the head chip 1 and flow passage forming member 4 are bonded to each other and are so sealed as to prevent the ink against leakage. The details of the shape of the flow passage forming member 4 will be discussed later.

The joint 6 is used to supply ink held in an ink tank (not shown) through the ink supply pipe 7. In particular, the joint 6 is inserted into the opening 3. The portion of the joint 6 that is inserted into the opening 3 has almost the same shape as the opening 3 and includes a surface almost parallel to the surface of the heat sink 2 except for the portion thereof to which the ink supply pipe 7 is connected. Sealed conditions are established between the surface of the joint 6 inserted portion and the back surface of the head chip 1 as well as between the surface of the joint 6 inserted portion and the back surface of the flow passage forming member 4. Due to this, the side surface of the head chip 1, the surface of the flow passage forming member 4 and the upper surface of the joint 6 can define an ink supply chamber 8 which extends in the arrangement direction of the injection ports 5. In this sealing operation, the shapes and positions of these components must be matched well to each other so as to be able to prevent recessed or projected portions from being produced in the sealed portions as much as possible. For example, the side wall of the ink supply pipe 7 and the side wall of the head chip 1 must be structured such that they provide a straight line. This structure can reduce the possibility of air bubbles and dust being stagnated, which in turn can reduce the possibility that ink cannot be jetted out properly. The ink that is supplied from the ink Supply pipe 7 is supplied through the ink supply chamber 8 into the individual ink flow passages and, due to generation of air bubbles caused by the heat that is generated by the heating elements, the inks in the ink flow passages can be jetted out from the injection ports 5. Also, such formation of the ink flow passages can eliminate the possibility that the ink can be contacted with the heat sink 2, thereby being able to prevent the heat sink 2 from being corroded due to the ink.

The peripheral portion of the ink supply port of the ink supply pipe 7 is cut into an oblique shape and, therefore, when a sealed condition is established between the joint 6, flow passage forming member 4 and head chip 1, even if part of the seal member sticks out, there is eliminated the possibility that the ink supply pipe 7 can be clogged by such sticking-out seal member. Also, if the seal member sticks out into the oblique portion, then the oblique portion provides a smooth ink flow passage wall. By the way, preferably, in the intermediate portion of the ink supply pipe 7, there may be inserted a filter which is used to remove dust and air bubbles existing in the ink.

In the above-mentioned embodiment, there is shown a case in which a sealed condition is set up between the joint 6 and the bottom surface of the flow passage forming member 4. However, this is not limitative but, for example, one end of the joint 6 may be so formed as to extend up to the upper portion of the ink supply chamber 8, so that a sealed condition can be realized by the small thickness portion of the flow passage forming member 4. Or, on the contrary, there may be provided a projection which starts from the bottom surface of the flow passage forming member 4 and extends through the opening 3 of the heat sink 2, and the projection may be connected to the joint 6 on the back surface side of the heat sink 2.

Also, instead of provision of the opening 3 in the heat sink 2, the end portion of the heat sink 2 can be used. That is, the head chip 1 is disposed such that it covers the end portion of the heat sink 2, while the flow passage forming member 4 is connected to the joint 6. In this case, there is omitted the portion of the heat sink 2 that is shown separately on the left side of FIG. 1.

Figure 5:
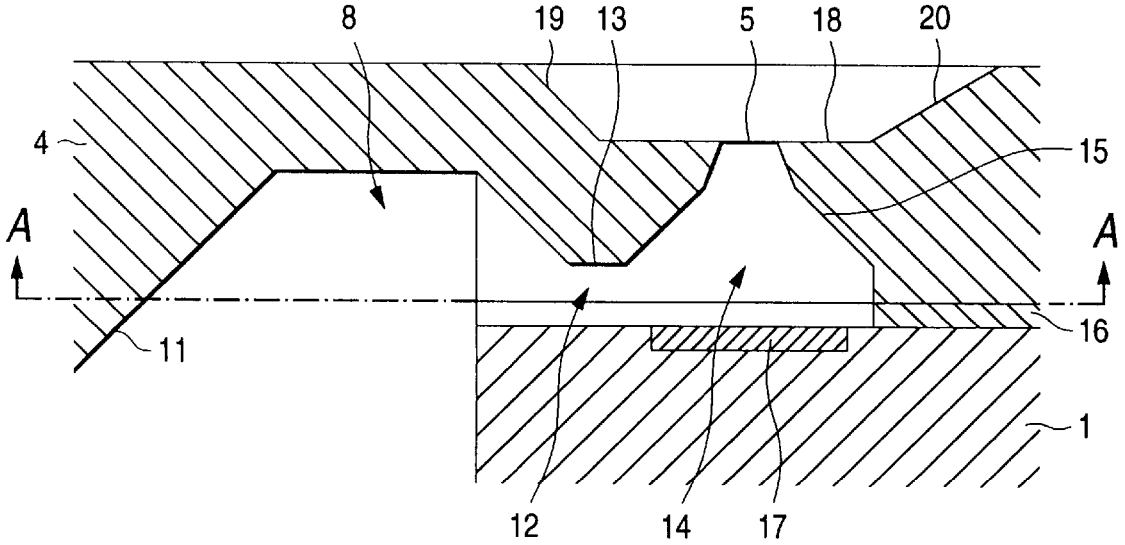
FIG. 5 is an enlarged view of an example of an injection port neighboring portion of the first embodiment of an ink jet print head according to the invention.
Figure 6:
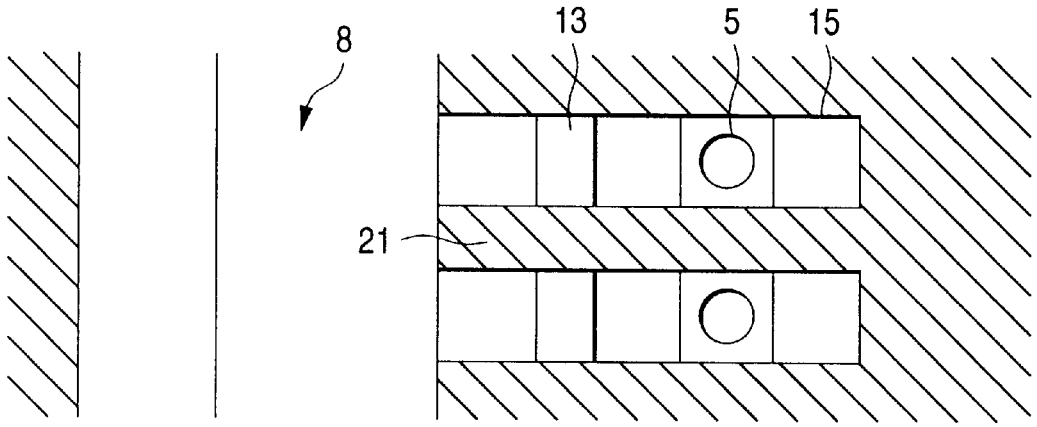
FIG. 6 is a section view of the example of an injection port neighboring portion of the first embodiment of an ink jet print head according to the invention, taken along the line A—A shown in FIG. 5.

Now, FIG. 5 is an enlarged view of an example of the injection port neighboring portion of the first embodiment of an ink jet print head according to the invention, while FIG. 6 is a section view taken along the line A—A shown in FIG. 5. In these figures, reference character 11 designates an ink supply chamber oblique surface, 12 a rear channel, 13 a rear narrowing portion, 14 a front channel, 15 a front side narrowing portion, 16 a flattening protection layer, 17 a heating element, 18 an injection port surface, 19 a rear recessed portion slope, 20 a front recessed portion slope, and 21 a partition.

As shown in FIG. 1, the flow passage forming member 4 is formed in such a manner that it is reduced in thickness from the sealed portion thereof with the joint 6 toward the upper portion of the head chip 1, while the flow passage of the ink supply chamber 8 is narrowed down toward the upper surface of the head chip 1 by the ink supply slope 11. Since the other portions of the flow passage forming member 4 than the portion thereof that is situated on the upper portion of the head chip 1 can be so formed as to have a sufficient thickness, the flow passage forming member 4 can be made to have a sufficient strength as a part and can be thereby made easy to handle.

The ink supply slope 11 is formed such that, when a pressure generated on the heating element 17 is propagated to the ink supply chamber 8, it prevents the reflected wave of this pressure from returning again to the heating element side. Since the ink supply slope 11 is set at an angle of 45° or so, the pressure reflected wave can be made to be diffused to the joint side. This prevents a crosstalk and a secondary ink jet to thereby be able to provide an excellent image quality. Also, because the ink flows along the ink supply chamber slope 11 of the flow passage forming member 4, the ink does not stagnate but flows smoothly, so that the supply of the ink can be carried out properly.

Also, in the upper portion of the head chip 1, there are formed individual flow passages which are separated from one another by partitions 21 in correspondence to the respective heating elements 17 disposed on the head chip 1, while these individual flow passages are connected to the ink supply chamber 8. In the connected portions of the individual flow passages, the upper surface of the ink supply chamber 8 is recessed from the upper surface of the head chip 1, which reduces the resistance of the ink when it flows into the individual flow passages. Also, since the ink supply chamber 8 is larger in capacity than the individual flow passages and the volume of the ink supply chamber 8 is increased due to provision of the recessed portion in the upper portion thereof, even when a large amount of ink is supplied, for example, when ink is jetted out from all the nozzles, there is eliminated the possibility that the ink supply chamber 8 can run short of ink, so that, when ink is consumed, the supplement of ink can be executed properly in every individual flow passage.

Each of the individual flow passages is composed of a rear channel 12 and a front channel 14. The rear channel 12 is formed by arranging the partition 21 such that it extends up to the end of the head chip 1, or a position before such end, or a position beyond such end. The rear channel 12 is used to prevent generation of a crosstalk. The rear channel 12 includes the rear narrowing portion 13 which is used to narrow down the ink flow passage in the opposite direction to the ink jetting direction. The slope of the rear narrowing portion 13 on the ink supply chamber 8 side is structured such that the cross section of the flow passage can be decreased gradually from the recessed portion of the upper portion of the ink supply chamber 8, thereby being able to reduce the flow passage resistance from the ink supply chamber 8 to the front channel 14 as much as possible. On the contrary, in the portion of the rear channel 12 that is situated nearer to the ink supply chamber 8 side than the rear narrowing portion 13, there is formed a flow passage which is deep in the thickness direction of the flow passage forming member 4, thereby being able to realize a low flow passage resistance. Also, due to the slope of the rear tightening portion 13 on the front channel 14 side, the pressure of air bubbles generated on the heating elements 17 can be directed to the injection ports 5 with high efficiency and such pressure is prevented from being propagated to the ink supply chamber 8 side as much as possible, which keeps the ink from flowing backward to thereby prevent generation of a crosstalk. Such shape of the rear narrowing portion 13 can improve the ink refilling property, increase the ink jetting force, and enhance the ink jetting efficiency. Further, since the roar narrowing portion 13 does not narrow down the ink flow passage in the arrangement direction of the injection porte 5, the individual flow passages do not require an extra width, that is, the individual flow passages can be reduced in width to thereby enhance the arrangement density of the individual flow passages, so that there can be provided an ink jet print head of a high density.

In the bottom portion of the front channel 14, there is disposed the heating element 17. The front channel 14 serves as an air bubble growth chamber which facilitates the growth of air bubbles generated in the ink due to heat produced by the heating element 17. The heating element 17 is formed in a substantially rectangular shape which is long in the direction of the individual flow passages. This can reduce the widths of the injection ports 5 in the arrangement direction thereof, and can enhance the arrangement density of the heating elements 17, which makes it possible to produce a compact and high-density ink jet print head. Also, similarly to the shape of the heating element 17, the front channel 14 is also formed such that the section thereof almost parallel to the heating element 17 has a substantially rectangular shape.

Also, in the upper portion of the front channel 14, there is formed the injection port 5. The front channel 14 is narrowed down in the ink flow passage direction from the heating element 17 toward the injection port 5, so that the front channel 14 has a shape similar to a fluid diode. Due to this, the ink can he jottod out from the injection port 5 by making effective use of the pressure of the air bubbles generated on the heating element 17. Further, the portion of the injection port 5 is also machined in a tapered manner. That is, the portion of the front channel 14 and the portion of the injection port 5 cooperate together in forming a two-stage narrowing structure. Due to this structure, the pressure of the air bubbles generated on the heating element 17 when they grow can be made to converge into the injection port 5 in the narrowing portion of the front channel 14, and the narrowing effect can be enhanced by the narrowing portion of the injection port 5, thereby being able to increase the flow rate of the ink to be jetted. This leads to an ink jet print head which provides a high energy efficiency. Here, in the present embodiment, as shown in FIG. 6, the section of the front channel is substantially rectangular, while the section of the portion of the injection port 5 is substantially circular or substantially elliptical.

As described above, the front channel 14 is shaped in such a manner that the section thereof parallel to the heating element, as shown in FIG. 6, is substantially rectangular, and also that the section thereof extending at right angles to the surface of the heating element 17 and including the ink flow passage, as shown in FIG. 5, is narrowed down toward the injection port 5. Thanks to this shape, the front channel 14 allows the heating element 17 to generate the air bubbles and also can secure a volume necessary to jet out the ink. Referring here to the volume V of the front channel 14 portion up to the injection port 5, for example, as disclosed in the Unexamined Japanese Patent Application Publication No. Hei 4-118247, where the pitch of a dot to be recorded is expressed as p, it can be obtained in the following manner:

$$V \geq \pi\left(p/\sqrt{2}\right)^3/48$$

If this condition is satisfied, then the ink jetting efficiency can be enhanced in the range where the air bubbles generated on the heating element 17 are not in communication with the air, thereby being able to realize the stabilized ink jetting condition.

The injection port surface 18 of the flow passage forming member 4 including the injection port 5 is formed such that it is recessed from the other remaining areas of the flow passage forming member 4, thereby reducing a distance between the surface of the heating element 17 to the injection port 5. For example, the distance from the heating element 17 to the injection port 5 can be set 100 $\mu$m or less. This recessed surface can enhance the ink jetting performance Also, the two sides of the recessed surface are enclosed by a rear recessed slope 19 and a front recessed slope 20 respectively. The rear recessed slope 19 and front recessed slope 20 are respectively formed gentle in inclination and, therefore, in a wiping operation, a wiping blade can be easily contacted with the injection port surface. Also, the inclination of the rear recessed slope 19 is formed slightly steeper, which makes it easier to secure a sufficient height for the flow passage from the rear channel 12 to the ink supply chamber 8, thereby increasing the strength of the flow passage forming member 4. Further, the other portions of the flow passage forming member 4 than the injection port surface 18 thereof are formed higher than the injection port surface 18 to thereby increase the thickness of the flow passage forming member 4. Especially, in the recessed portion of the upper portion of the ink supply chamber 8, not only a sufficient recessed dimension is provided but also the strength of the flow passage forming member 4 is maintained.

Figure 7:
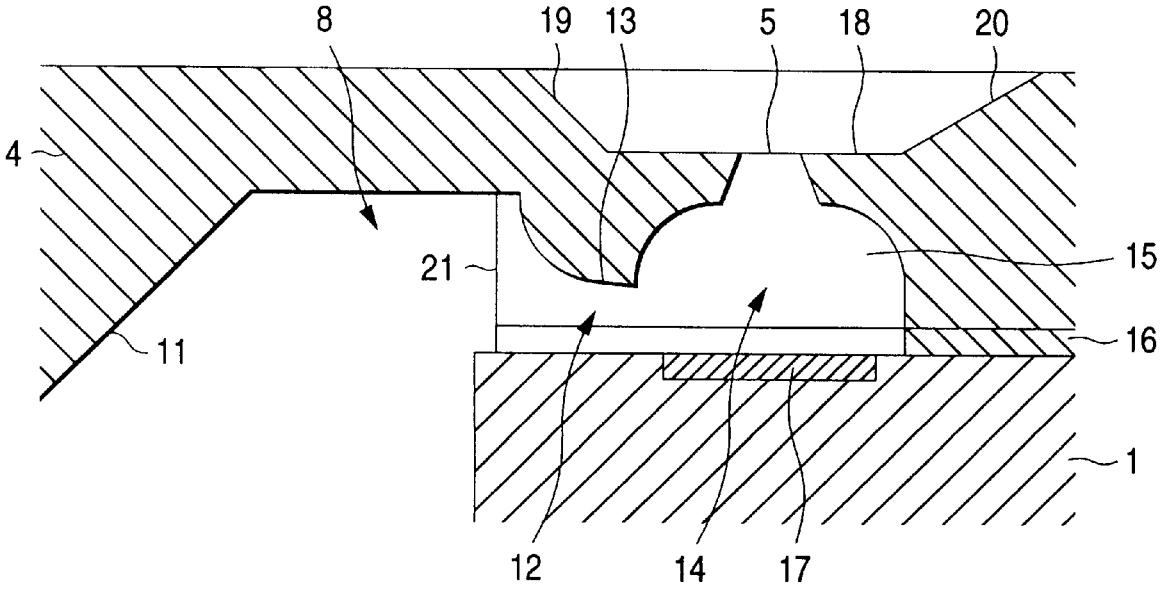
FIG. 7 is an enlarged view of another example of an injection port neighboring portion of the first embodiment of an ink jet print head according to the invention.

Now, FIG. 7 is an enlarged view of another example of the injection port neighboring portion of the first embodiment of an ink jet print head according to the invention. In FIG. 7, reference characters are similar to those shown in FIG. 5. In this example, the rear narrowing portion 13 is formed such that the two side slopes thereof are different in shape from each other. That is, the slope of the rear narrowing portion 13 on the ink supply chamber 8 side is formed in a curved line, which reduces the fluid resistance of the ink from the ink supply chamber 8 to the front channel 14.

On the other hand, the slope of the rear narrowing portion 13 on the front channel 14 side is so formed as to rise steeply, which not only increases the fluid resistance of the ink when the ink flows reversely from the front channel 14 to the ink supply chamber 8, but also allows the pressure generated on the heating element 17 to be used with high efficiency within the front channel 14.

Such shape of the rear narrowing portion 13 can enhance the ink refilling property further, can increase the drive frequencies to thereby increase the speed of the ink jetting operation, and can enhance the ink jetting force to thereby improve the ink jetting efficiency further.

Figure 8:
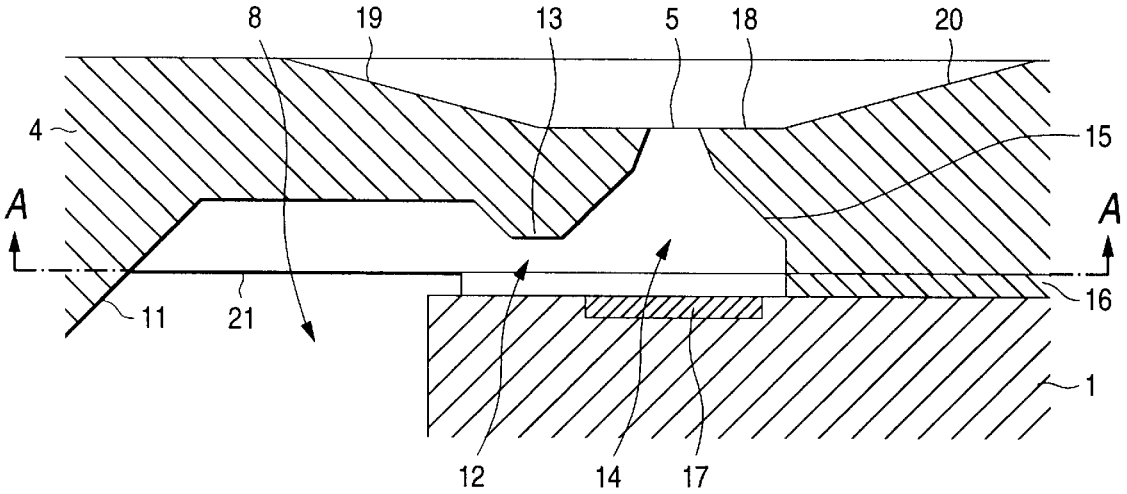
FIG. 8 is an enlarged view of still another example of an injection port neighboring portion of the first embodiment of an ink jet print head according to the invention.
Figure 9:
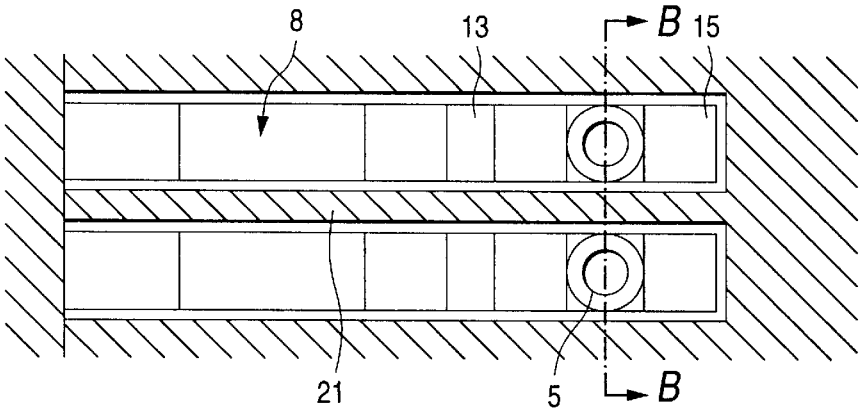
FIG. 9 is an enlarged view of yet another example of an injection port neighboring portion of the first embodiment of an ink jet print head according to the invention.
Figure 10:
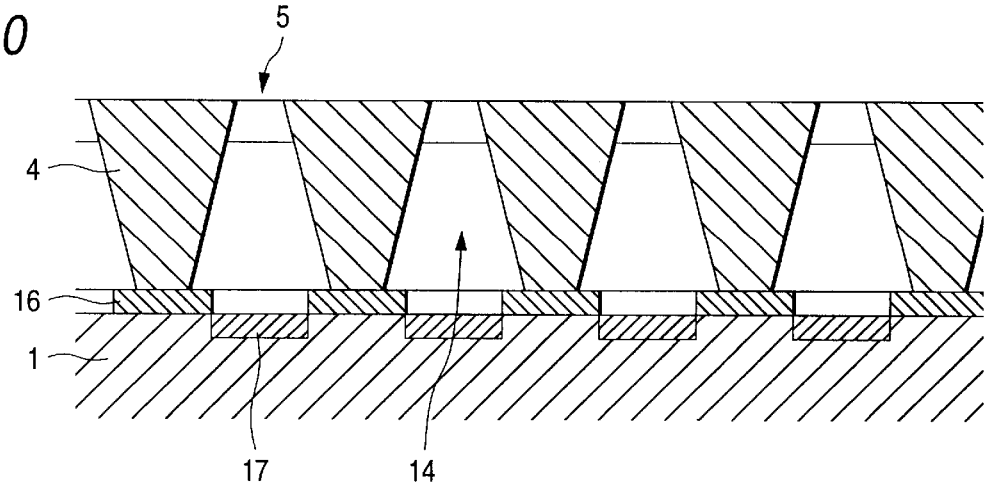
FIG. 10 is a section view of a further example of an injection port neighboring portion of the first embodiment of an ink jot print head according to the invention, taken along the line B—B shown in FIG. 9.

Now, FIG. 8 is an enlarged view of still another example of the injection port neighboring portion of the first embodiment of an ink jet print head according to the invention. Also, FIG. 9 is a section view which is taken along the line A—A shown in FIG. 8, while FIG. 10 is similarly a section view taken along the line B—B shown in FIG. 8. In this example, the partition 21 used to separate the individual flow passages from each other is extended up to the ink supply chamber 8. When the partition 21 is extended up to the ink supply chamber 8 in this manner, the extended portion functions just like a rib to thereby be able to increase the strength of the ink supply chamber 8 portion of the flow passage forming member 4. Also, as described above, the pressure of the air bubbles generated on the heating element 17 when the air bubbles are growing are propagated a little through the rear narrowing portion 13 from the individual flow passages to the ink supply chamber 8. However, due to the fact that the partition 21 is extended to the ink supply chamber 8, the pressure propagated to the ink supply chamber 8 is hard to be transmitted to the adjoining individual flow passage, which makes it possible to reduce a crosstalk further.

As described above, since the portion of the flow passage forming member 4 on the ink supply chamber 8 is increased in strength due to the extended partition 21, the rear recessed slope 19 can be so structured as to have a gentler angle. This structure in turn makes it possible to wipe the injection port surface 18 move effectively.

Also in the present example, as shown in FIGS. 9 and 10, the side surfaces of the partition 21 are also inclined slightly, which helps in increasing the narrowing of the ink flow passage in the front channel 14.

Further, as shown in FIG. 10, the width of the flattening protection layer 16 to be contacted with the partition 21 is set greater than the width of the leading end portion of the partition 21. Due to this structure, even if the flow passage forming member 4 and head chip 1 are slightly out of position with respect to each other when they are matched in position to each other, the leading end portion of the partition 21 and the flattening protection layer 16 can be connected to each other, which eliminates the possibility that the mutually adjoining individual passages can be in communication with each other. Also, such slight positional difference does not cause the leading end portion of the partition 21 to be overlapped on the heating element 17. Or, even if it is overlapped on the heating element 17, since there exist between the heating element 17 and partition 21 a space which corresponds to the thickness of the flattening protection layer 16, such overlapping has only a little influence on the generation and growth of the air bubbles.

Figure 11A:
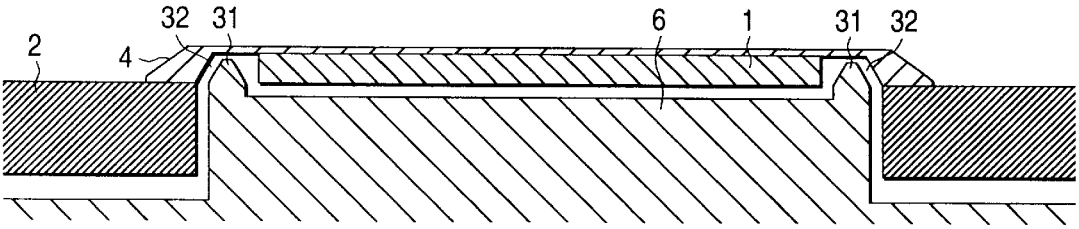
FIGS. 11A to 11C are enlarged views of an example of an end portion neighboring portion of the first embodiment of an ink jet print head according to the invention.
Figure 11B:
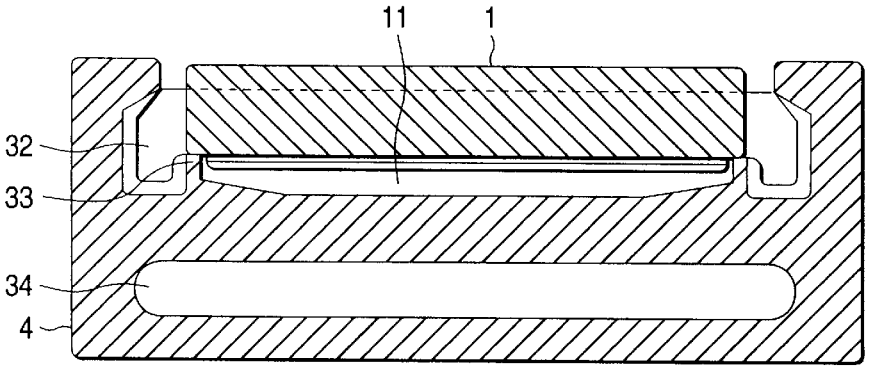
Figure 11C:
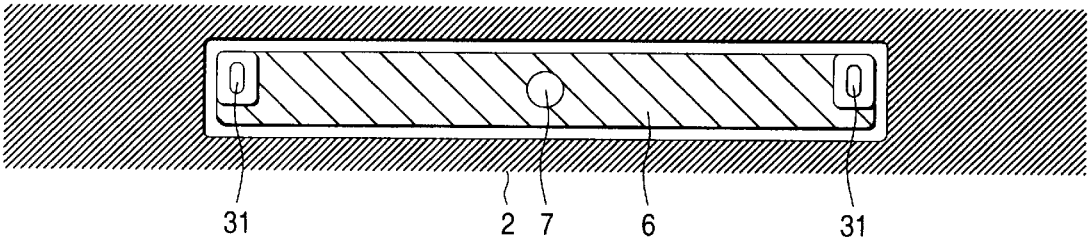

Now, FIGS. 11A to 11C are enlarged views of an example of the end neighboring portion of the first embodiment of an ink jet print head according to the invention. In particular, FIG. 11A is a section view thereof, FIG. 11B is a plan view of the flow passage forming member 4; and, FIG. 11C is a plan view of the joint 6. In these figures, reference character 31 designates projections, 32 joint projection receive portions, 33 seal material inflow prevention walls, and 34 a lightening hole.

In FIG. 1, description has been given hereinbefore to the effect that the sealing in the individual flow passage direction is carried out between the joint 6 and flow passage forming member 4 as well as between the joint 6 and head chip 1. In order to prevent the ink from leaking out, it is necessary to seal between the two end portions of the head chip 1 as well. As a structure for this purpose here, the projections 31 are provided in the joint 6, while there are formed recessed portions which act as the joint projection receive portions 32 of the flow passage forming member 4. If the projection 31 is inserted into the joint position receive portion 32, then there can be formed a space suitable for a sealing operation to be executed by the seal material. That is, the seal material within the joint 6 is spread out to the peripheral portions thereof by the projection 31 and is thereby filled between the projection 31, joint projection receive portion 32, and the side surface of the head chip 1, so that excellent sealing can be realized therebetween.

Also, the seal material inflow prevention wall 33 is interposed between the joint projection receive portion 32 and the ink supply chamber slope 11 forming the wall surface of the ink supply chamber 8. Provision of the seal material inflow prevention wall 33 eliminates the possibility that, when the sealing is attained by the projection 31 and joint projection receive portion 32, the seal material can stick out into the ink supply chamber 8 to interfere with the supply of the ink. However, if there is used a seal material which can stick out only a little amount, or if there is employed a structure in which, even if the seal material sticks out into the ink supply chamber 8, the sticking-out seal material is prevented from reaching the individual flow passages, then the seal material inflow prevention wall 33 can be omitted.

In this manner, by sealing between the projections 31 in the end portions of the joint 6, between the joint 6 and flow passage forming member 4, and between the joint 6 and head chip 1, a tightly closed ink supply chamber 8 can be provided, so that the ink to be supplied from the ink supply pipe 7 can be supplied to the individual flow passages with no leakage and thus can be used for recording effectively. Also, such sealing prevents the ink flow passage from being clogged with the seal material, thereby being able to enhance the yield rate of the ink jet print head.

Here, it is noted that the above-mentioned structure is not limitative but, for example, the projection may be provided on the flow passage forming member 4 side and the joint projection receive portion may be provided on the joint 6 side. Also, sealing is also possible by other means than the above-mentioned structures.

Also, as shown in FIG. 11, the ink supply chamber slope 11 of the flow passage forming member 4 is narrowed down in the neighborhood of the two end portions thereof, so that the ink supply chamber 8 is reduced in the cross section thereof in the two end portions thereof. This can accelerate the flow rate of the ink in the end portions of the ink supply chamber 8, can prevent the stagnation of the air bubbles and the like, and can reduce the poor image quality. Also, for example, in maintenance, the air bubbles are easy to remove and, therefore, in a normal printing operation, the printing operation is free from the influence of the air bubbles, so that the printing operation can be executed in an excellent manner.

Now, FIG. 12 is a flow chart of an example of a process for producing the first embodiment of an ink jet print head according to the invention. In FIG. 12, reference character 41 designates a silicon wafer, 42 a resin layer, 43 silver epoxy, 44 an adhesive agent, 45 an enclosure material, and 46 a seal material.

Figure 12A:
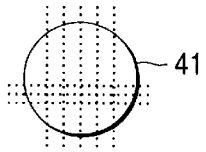
FIGS. 12A to 12G are flow chart of an example of a process for manufacturing the first embodiment of an ink jet print head according to the invention.

In particular, in FIG. 12A, a chip carrying a heating element and a drive circuit thereon is formed on the silicon wafer 41 according to an LSI producing process. The surface of the silicon wafer 41 is coated with a thin resin layer 42 formed of photosensitive resin, polyimide, non-photosensitive resin or the like, while the resin layer 42 serves not only as a flattening layer but also as a protection layer. This thin resin layer may also be formed of an adhesive layer. The silicon wafer 41 with the heating element and the like formed thereon is divided into a plurality of head chips 1 by dicing or by other similar means.

On the other hand, in the case of the flow passage forming member 4, by molding, there are formed the outer shape thereof, ink supply chamber 8, rear channel 12, rear narrowing portion 13, front channel 14, injection port surface 18, ink supply chamber slope 11, lightening hole 34, joint projection receive portions 32, and seal material inflow prevention wall 33. The shape of each individual flow passage defined by the rear channel 12, rear narrowing portion 13 and front channel 14 is complicated when compared with a uniform groove. However, since a plurality of individual flow passages each having such shape can be produced by molding, the flow passage forming member 4 can be manufactured very simply. Of course, the individual flow passages can also be machined by means of laser.

Also, as disclosed in the Unexamined Japanese Patent Application Publication No. Hei 2-121843, the Unexamined Japanese Patent Application Publication No. Hei 6-79874 and the like, the injection port 5 can also be machined by use of laser. Use of the laser machining can produce a tapered injection port with high precision and at low costs. Or, as disclosed in the Japanese Patent Application No. Hei 8-267098, a recess to be used as the injection port 5 is previously formed by molding and the injection port surface 18 is machined by laser to thereby open the injection port 5, or, a recess, which is to be used as an injection port 5 of a non-through type that it does not extend through the flow passage forming member 4, is formed by laser machining and the injection port surface 18 is then machined by laser from the opposite side to thereby open the injection port 5.

Figure 12B:
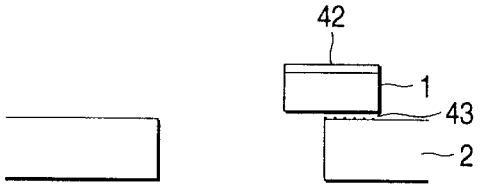
Figure 12C:
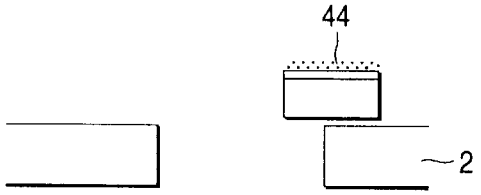

Each of the divided head chips 1, in a step shown in FIG. 12B, is connected to the heat sink 2 by means of the silver epoxy 43 or the like. Further, in a step shown in FIG. 12C, an adhesive agent is applied onto the head chip 1 and the flow passage forming member 4 is connected to the head chip 1 through the adhesive agent. In this step, an adhesive agent may be applied to the heat sink 2 as well and thus the flow passage forming member 4 may be connected to the heat sink 2 as well. Or, as shown in FIG. 12F, the flow passage forming member 4 and head chip 1 may be firstly connected to each other and, after then, as shown in FIG. 12G, the connected flow passage forming member 4 and head chip 1 may be connected to the heat sink 2. According to this assembling method, when there is employed a structure using a plurality of head chips, there can be eliminated the need to position the head chips in the heat sink 2 with high precision. Also, the connection of the head chips to the heat sink 1 side can be completed at a time.

Figure 12D:
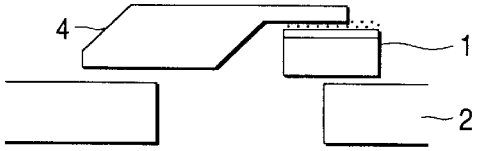

In a step shown in FIG. 12D, a wire on the head chip 1 and a wire on the heat sink 2 are electrically connected to each other by wire bonding, or according to a TAB method, or by use of an anisotropic conductive film, or the like. And, the electrically connected portions thereof are enclosed by the enclosure member 45 or the like in order to prevent the wires from being cut off.

Figure 12E:
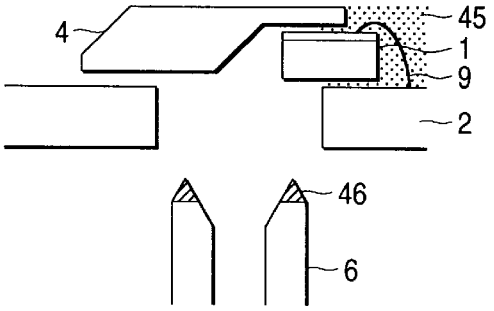
Figure 12F:
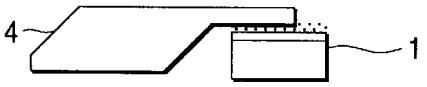
Figure 12G:
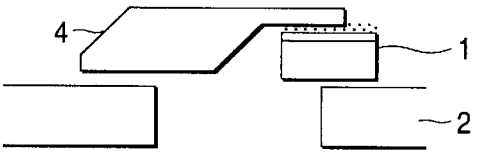

In a step shown in FIG. 12E, the seal material 46 formed of silicon, epoxy sealing agent or the like is applied to the joint 6 and is then inserted into the opening 3 of the heat sink 2, thereby establishing a sealed condition between the back surface of the head chip 1 and flow passage forming member 4. Also, in each of the side end portions of the present ink jet print head, the projection 31 of the heat sink 2 is inserted into the joint projection receive portion 32 of the flow passage forming member 4, thereby establishing a sealed condition between them and the side surface of the head chip 1. In this manner, the above-mentioned ink jet print head can be produced. Here, the seal material 46 may also be applied to the head chip 1, flow passage forming member 4 and heat sink 2 side.

As described above, the head chip 1 and flow passage forming member 4 are placed onto the heat sink 2 while they are matched in position to each other and, after then, the joint 6 is inserted through the opening 3. That is, since the assembling operation of the first embodiment of the present ink jet print head can be completed in a simple process, there can be supplied an ink jet print head which is easy to manufacture, can be manufactured at low costs and can show a stable quality. In this manufacture, the flow passage forming member 4 can be shaped such that, as described before, the other portions thereof than the portion thereof situated on the upper portion of the head chip 1 have a sufficient thickness. Due to this, the flow passage forming member 4 can be so formed as to have a sufficient strength as a part of the print head and also the flow passage forming member is easy to handle while it is being manufactured.

Figure 13A:
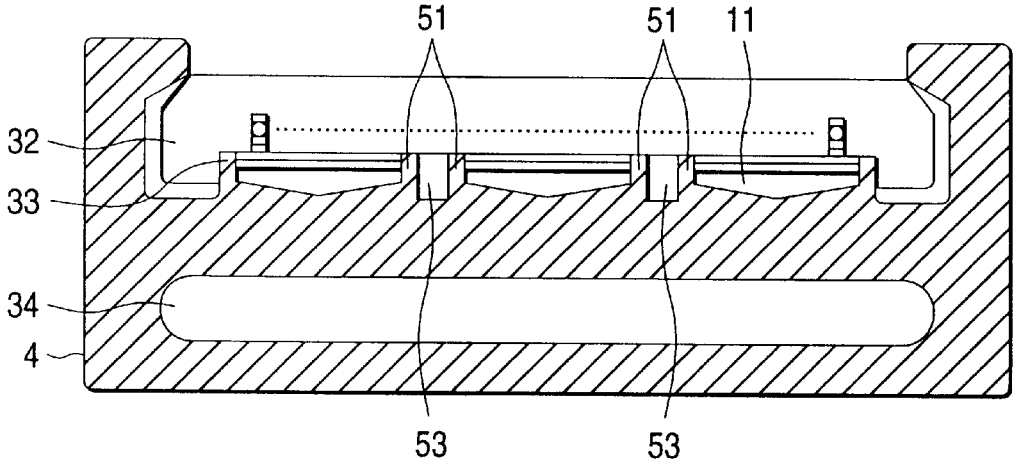
FIGS. 13A to 13C are structural views of a second embodiment of an ink jet print head according to the invention.
Figure 13B:
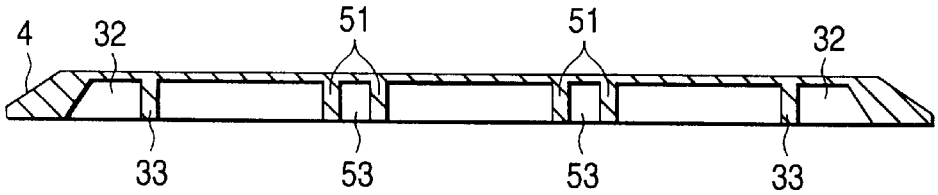
Figure 13C:
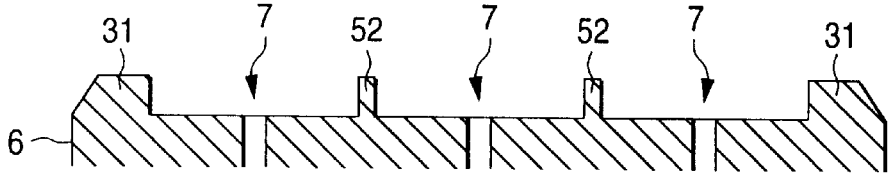

Now, FIGS. 13A to 13C show the structure of a second embodiment of an ink jet print head according to the invention. In particular, FIG. 13A is a plan view thereof when it is viewed from the back surface of a flow passage forming member 4; FIG. 13B is a section view thereof; and, FIG. 13C is a section view of a joint 6 corresponding to the flow passage forming member 4. In these figures, reference character 51 designates a separation wall, 52 stands for a projection, and 53 represents a separation wall recessed portion. In the present embodiment, in the intermediate portion of the ink supply chamber slope 11 of the flow passage forming member 4, there is provided a separation wall 51 similar in structure to the before-mentioned seal material inflow prevention wall 33. And, the joint 6 also includes a projection 52 which is similar to the before-mentioned projection 31 and is situated at a position corresponding to the separation wall 51. By inserting the projection 52 into a separation wall recessed portion 53 formed between the separation walls 51, there is formed a proper space for sealing by use of the seal material. Due to this structure, a properly sealed condition can be realized between the projection 52, separation recessed portion 53 and head chip 1.

Also, the separation wall 51, similarly to the seal material inflow prevention wall 33, prevents the seal material from sticking out. By sealing the separation wall 51, the side surface of the head chip 1 and joint 6, there can be formed a plurality of separated ink supply chambers 8. In the embodiment shown in FIG. 13, three ink supply chambers 8 are formed.

Individual ink supply pipes 7 can be connected to their associated ink supply chambers 8, respectively. By supplying inks of different colors from the respective ink supply pipes 7, in the present embodiment, three color recording can be achieved by use of one print head and thus full color recording is possible. Of course, the ink supply chamber 8 may be divided to two, or four or more so that two or four or more kinds of inks can be used. Or, inks having different characteristics may be used.

Here, when there is used a seal material which sticks out only a little, or when there is employed such design that prevents the seal material from reaching the individual flow passages even if it sticks out, then the separation wall 51 can be omitted and, in this case, a sealed condition may be established between the projection 52, flow passage forming member 4 and head chip 1.

Figure 14A:
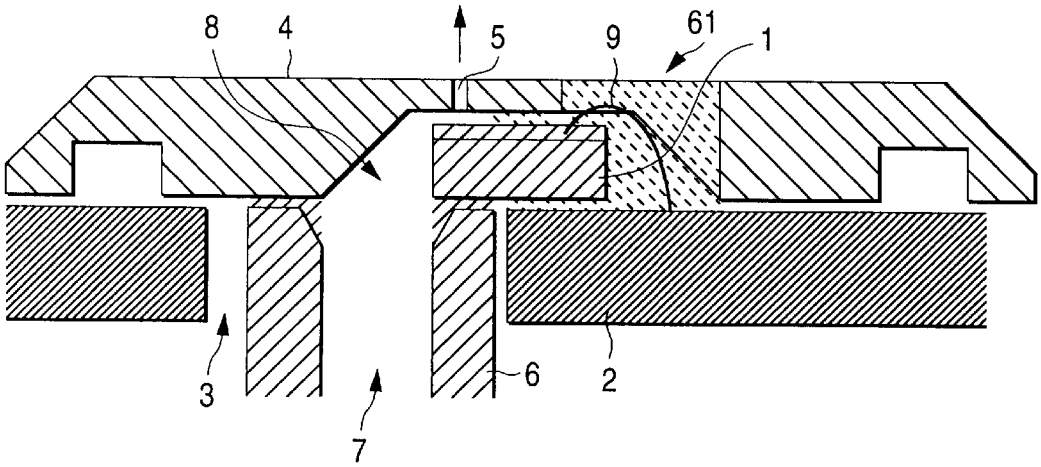
FIGS. 14A and 14B are section view and a plan view of a third embodiment of an ink jet print head according to the invention.

Now, FIG. 14 shows a section view and a plan view of a third embodiment of an ink jet print head according to the invention. In these figures, reference character 61 designates a connection portion opening, while 62 stands for a reed electrode. In the third embodiment, the flow passage forming member 4 is so formed as to extend up to the opposite side of the head chip 1. Such extension of the flow passage forming member 4 can increase the strength of the flow passage forming member 4 and, by connecting the extended portion of the flow passage forming member 4 to the heat sink 2, the fixation of the flow passage forming member 4 can be attained more positively. Also, because the thin portion or the flow passage forming member 4 in which the injection ports are formed is not exposed as the end portion thereof, breakage or the like can be reduced. Further, since the two end portions of the flow passage forming member 4 shown in FIG. 14A can be respectively formed as slopes, a wiping operation can be carried out more effectively.

On the opposite side of the head chip 1 to the ink supply chamber 8 side, there is arranged an electrically connecting portion which is used to supply various control signals, image signals and the like to a heating element 17 provided on the head chip 1 or a drive circuit for driving the heating element 17. The reed electrode 62, which is part of a wire provided on the heat sink 2, is electrically connected to the head chip 1 by a bonding wire 9. The flow passage forming member 4 includes a connecting portion opening 61 which is formed in the above-mentioned electrically connecting portion.

The electrically connecting portion of the head chip 1, as previously described in connection with FIG. 12D as well, is enclosed by the enclosure agent 45. By forming the connecting portion opening 61, the position of the enclosure agent can be regulated, which facilitates the management of the height of the enclosure agent 45. This not only prevents the short covering of the bonding wire 9, but also prevents the inflow of the enclosure agent 45 into the injection port 5 due to the excessive amount of the enclosure agent 45 as well as the interference of the enclosure agent 45 with a recording sheet due to the excessive rising of the enclosure agent 45. Further, since the connecting portion is protected by the periphery of the connecting portion opening 61, the reliability of the ink jet print head can be improved.

Figure 14B:
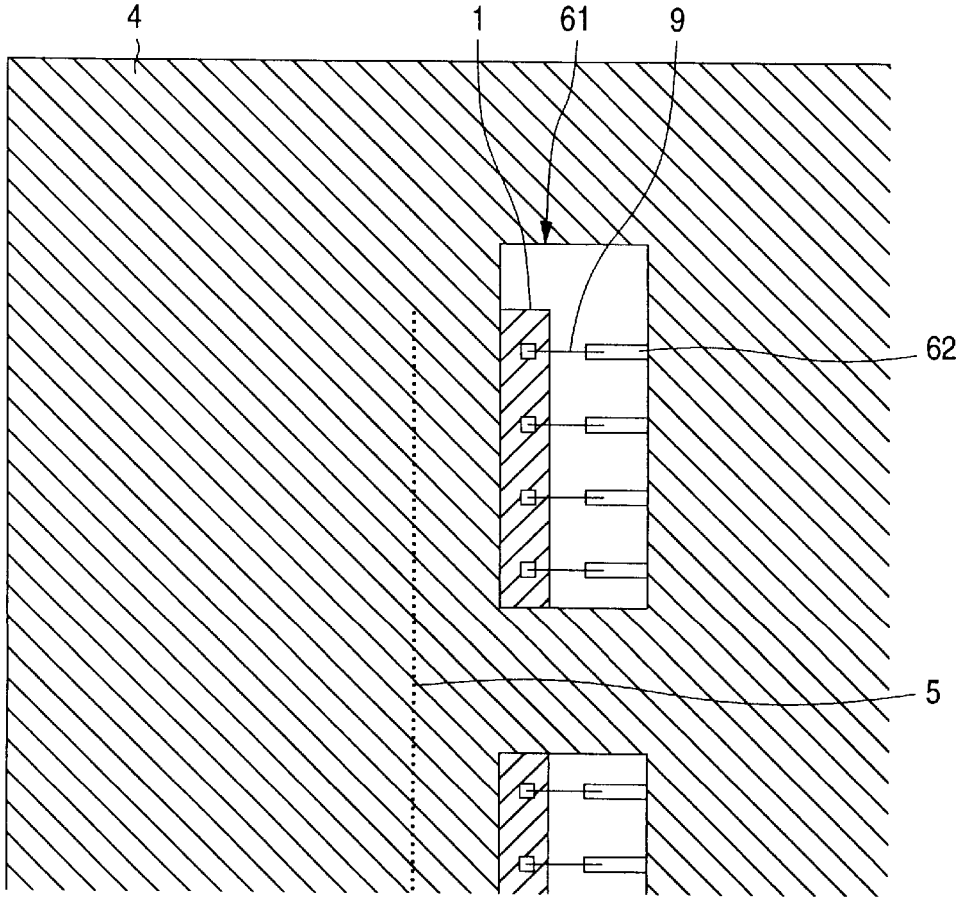

Here, in a structure shown in FIG. 14B, the connecting portion opening 61 of the head chip 1 is divided to a plurality of sub-sections. According to this structure, the portion of the flow passage forming member 4 situated on the head chip 1 can be increased in strength. Of course, the connecting portion opening 61 can also be formed as an integrally continuing slit-shaped opening.

Figure 15A:
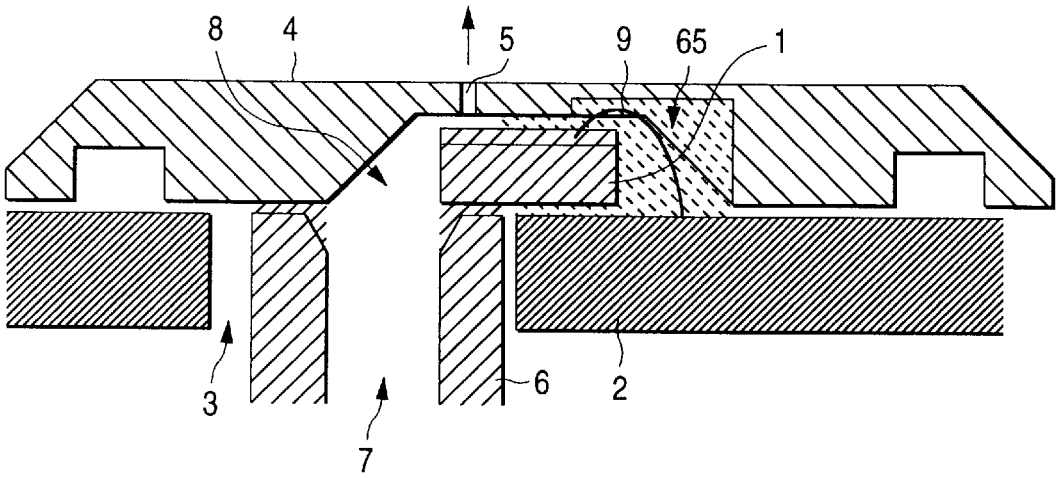
FIGS. 15A and 15B are section view of a modification of the third embodiment of an ink jet print head according to the invention.
Figure 15B:
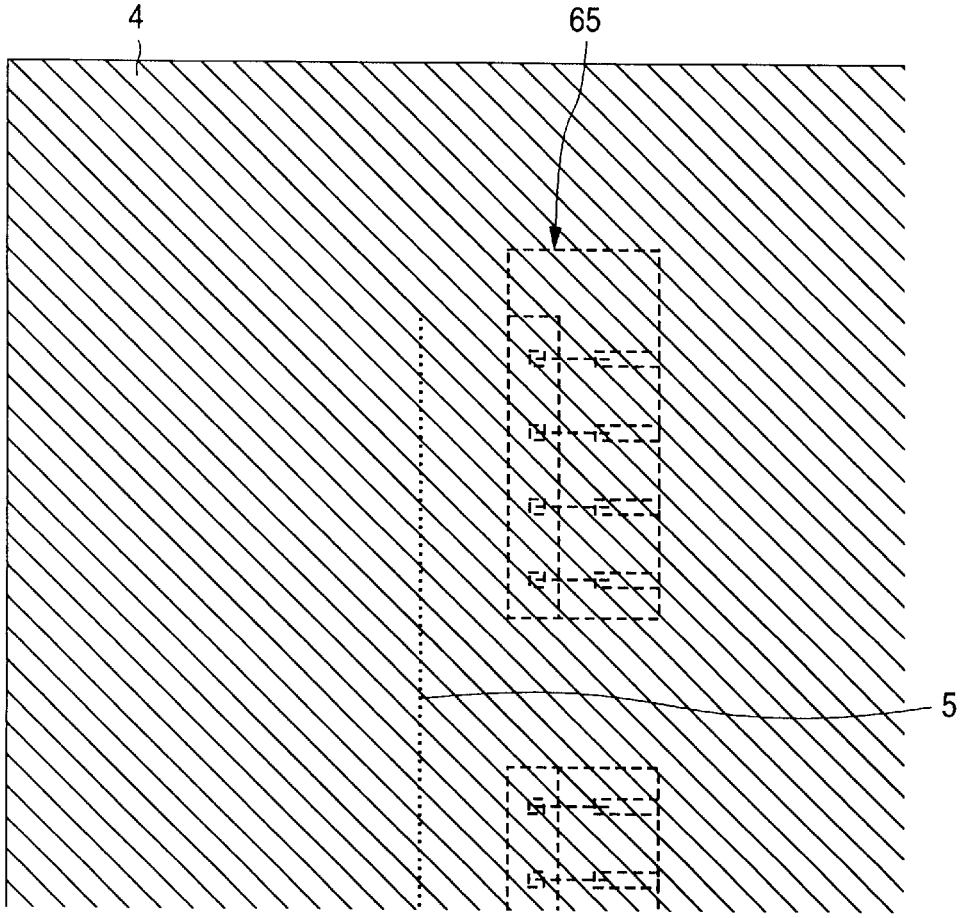

Now, FIG. 15 is a section view of a modification of the third embodiment of an ink jet print head according to the invention. In FIG. 15, reference character 65 designates a connecting portion recessed portion. As described above, in FIG. 14, the connecting portion opening 61 is formed in the flow passage forming member 4 in correspondence to the electrically connecting portion of the head chip 1. However, when the above-mentioned bonding between the reed electrode 62 and head chip 1 requires only the small height of the enclosure agent 45, or when the electrically connecting portion and the ink flow passages are enclosed properly, it is not essential to form the connecting portion opening 61. In the modified version shown in FIG. 15, the connecting portion recessed portion 65 is formed in the flow passage forming member 4 in correspondence to the electrically connecting portion. The bonding portion is stored in the connecting portion recessed portion 65. In this case, the connecting portion opening 61 is omitted. By the way, in a structure shown in FIG. 15B, the connecting portion recessed portion 65 is shown by broken lines and, in this structure, similarly to the above-mentioned connecting portion opening 61, the connecting portion recessed portion 65 is divided to a plurality of sub-sections. Of course, the connecting portion recessed portion 65 can also be formed as a continuing recessed portion.

Figure 16:
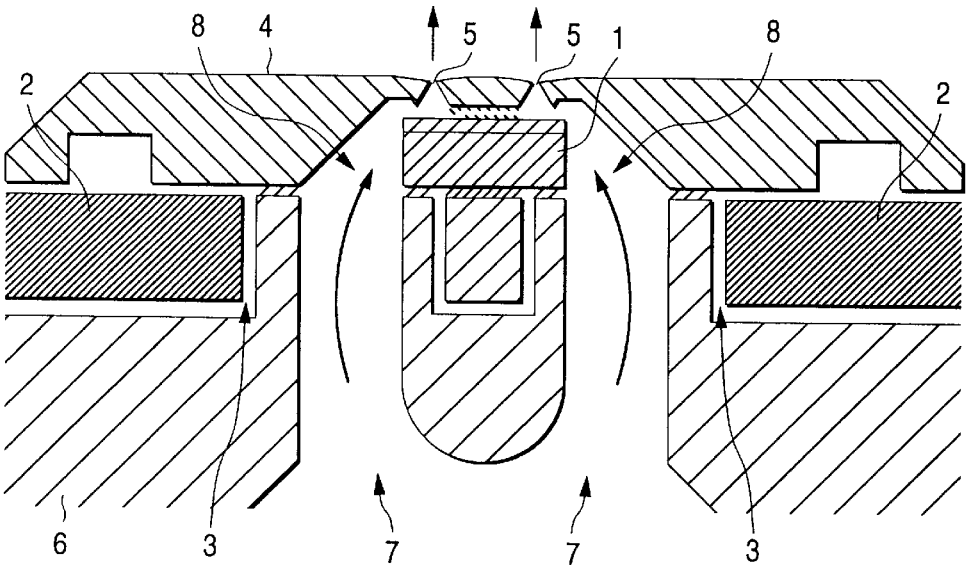
FIG. 16 is a section view of a fourth embodiment of an ink jet print head according to the invention.
Figure 17:
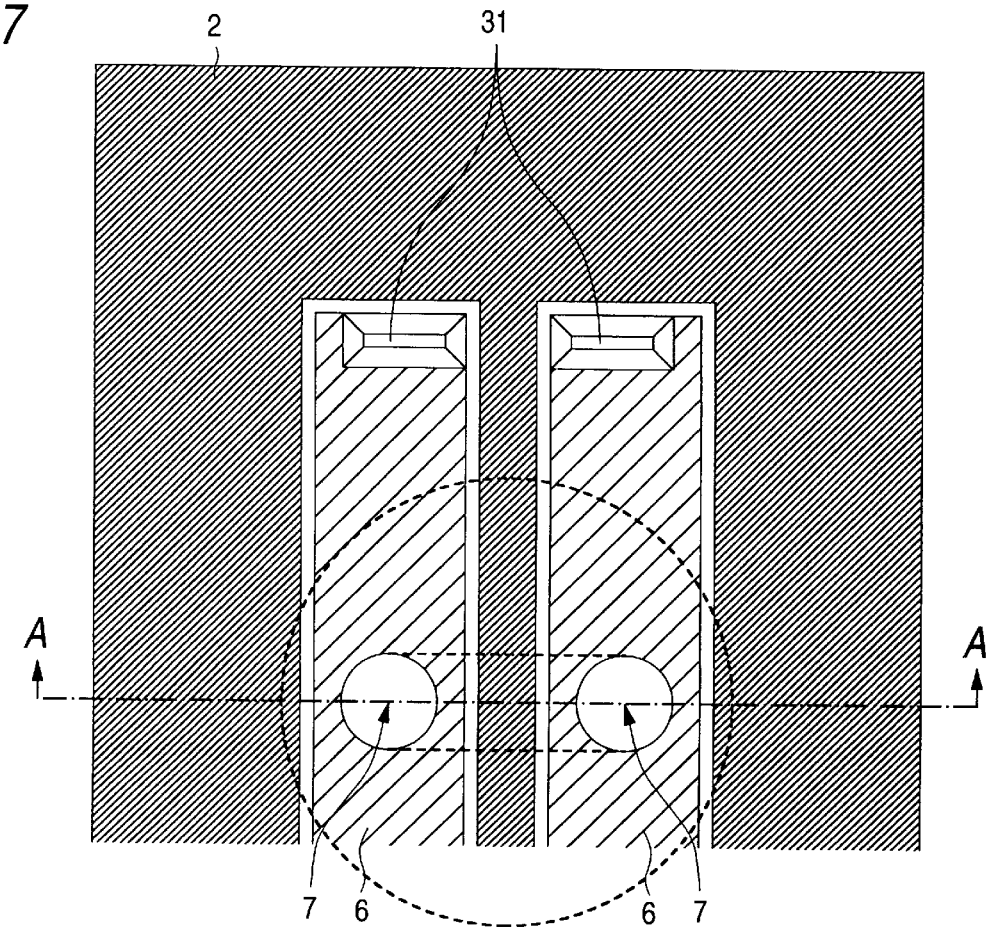
FIG. 17 is a plan view of the fourth embodiment of an ink jet print head according to the invention, viewed from above the heat sink thereof.
Figure 18:
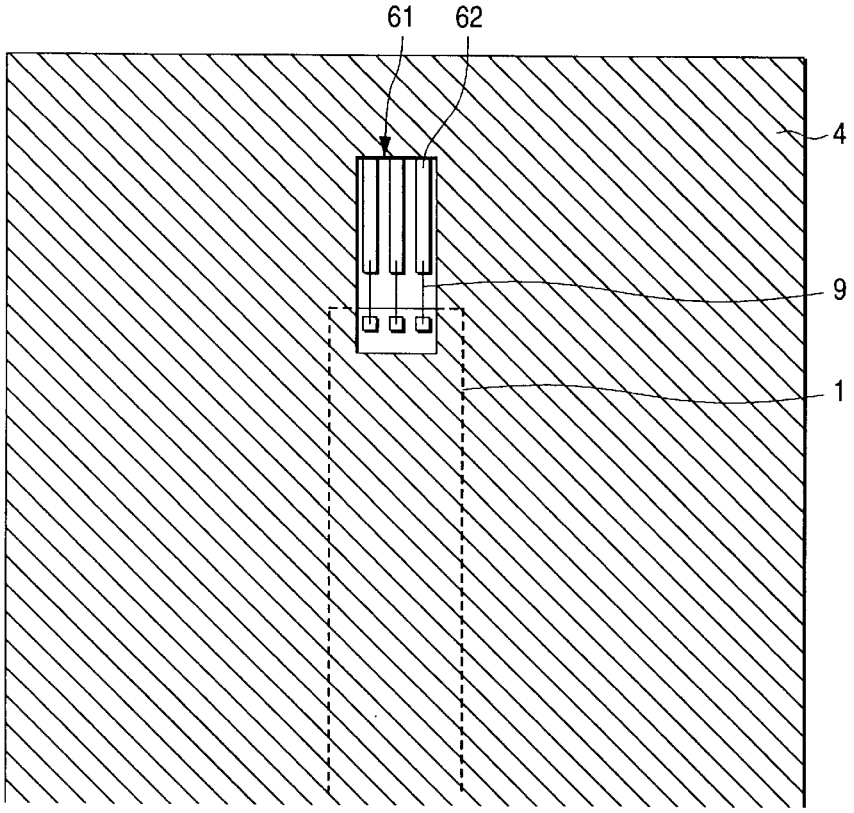
FIG. 18 is a plan view of the fourth embodiment of an ink jet print head according to the invention, showing mainly the flow passage forming member thereof.

Now, FIG. 16 is a section view of a fourth embodiment of an ink jet print head according to the invention, FIG. 17 is a plan view of a heat sink employed in the fourth embodiment, and FIG. 18 is a plan view of a flow passage forming member similarly employed in the fourth embodiment. In other words, FIG. 16 is a section view taken along the line A—A shown in FIG. 17. In the present embodiment, there is shown a structure in which heating elements are arranged on the two sides of the head chip 1 and ink is supplied from the two sides of the head chip 1.

As shown in FIG. 17, in the heat sink 2, there are formed two openings 3 which respectively extend in the arrangement direction of the injection ports 5. Between the two openings 3, as shown in FIG. 16, there is interposed the head chip 1. Due to this, the distance between the two openings 3 is narrower than the width of the head chip 1 by an amount which corresponds to an amount necessary for insertion of the joint 6. However, the heat sink 2 is formed of a metal substrate and, therefore, in spite of such narrow distance, it has a sufficient strength. In other words since the heat sink 2 consisting of a metal substrate is disposed in the central lower portion of the head chip 1 to support the head chip 1, when compared with a conventional structure using no heat sink, the present structure is more advantageous in mechanical strength and thus more advantageous when it is extended in length. In particular, in a conventional ink jet print head using no heat sink 2, because the central lower portion of the head chip 1 is hollow, for example, if a strong force is applied thereto when capping or wiping the ink jet print head in maintenance, then there is a fear that the print head can be broken. On the other hand, the present structure has a sufficient strength to protect the print head against breakage. Also, the thermal expansion coefficient of the heat sink 2 is between that of the component of the head chip 1 such as Si and that of the component of the flow passage forming member 4 such as plastics, so that a difference between the thermal expansion levels of the components can be balanced. By the way, when extending the length of the print head, as the head chip, an integrally formed head chip may be used or it may be divided to sub-sections before it is assembled into the print head.

The present flow passage forming member 4 has a shape which consists of a combination of two flow passage forming members shown in FIG. 1 arranged right and left symmetrically to each other. And, the present flow passage forming member 4 is so disposed as to cover the head chip 1 and the two openings 3. Referring to the injection ports 5, there are disposed two lines of injection ports 5 in correspondence to the heating elements provided in the head chip 1. Also, on the two sides of the head chip 1, there are formed spaces which are respectively used as ink supply chambers 8. Referring to the structures of the ink supply chambers 8, individual flow passages, injection port 5 neighboring portions and the like, the respective right and left sections thereof can be constructed similarly to that of the previously described first embodiment.

The joint 6 includes two ink supply pipes 7 which are respectively inserted through the two openings 3 and are sealed by the flow passage forming member 4 and the back surface of the head chip 1. Due to this structure, the ink can be supplied from the two sides of the head chip 1 up to the surface of the head chip 1 while preventing the ink from being contacted with the heat sink 2. In the structure shown in FIG. 16, the two ink supply pipes 7 are connected to each other in the lower portions thereof. Therefore, the present ink jet print head is a head which carries out a single color recording operation. However, it is also possible that two different colors can be supplied to the two ink supply pipes 7 to thereby provide a multi-color print head.

Now, in the structure of the fourth embodiment, electrical connection by means of the bonding wire 9 or the like is carried out from the lateral side of the print head from which no ink is supplied. For example, similarly to the third embodiment shown in FIG. 14, in correspondence to the electrically connecting portion, as shown in FIG. 18, a connecting portion opening 61 may be formed in the flow passage forming member 4 so that enclosure using an enclosure agent can be achieved positively.

As in the fourth embodiment, when the heating elements are arranged on the two sides of the head chip 1, the number of injection ports 5 to be formed can be made double and the recording speed can be enhanced. Also, if the right and left injection ports 5 are displaced in position with respect to the scanning direction, that is, they are arranged in a cross-stitch manner, then dots can be recorded at a spacing which is half of the arrangement density of the injection ports 5, thereby being able to improve the resolution of the dots. Or, if, in each of the two lines, the diameter of the injection ports 5, the heating area of the heating elements and the like are changed, then the gradation expression of the dots in recording can be improved. In this case, the two lines of injection ports 5 may be arranged in a cross-stitch manner, or may not be arranged in a cross-stitch manner but may be displaced in parallel to each other.

Figure 19:
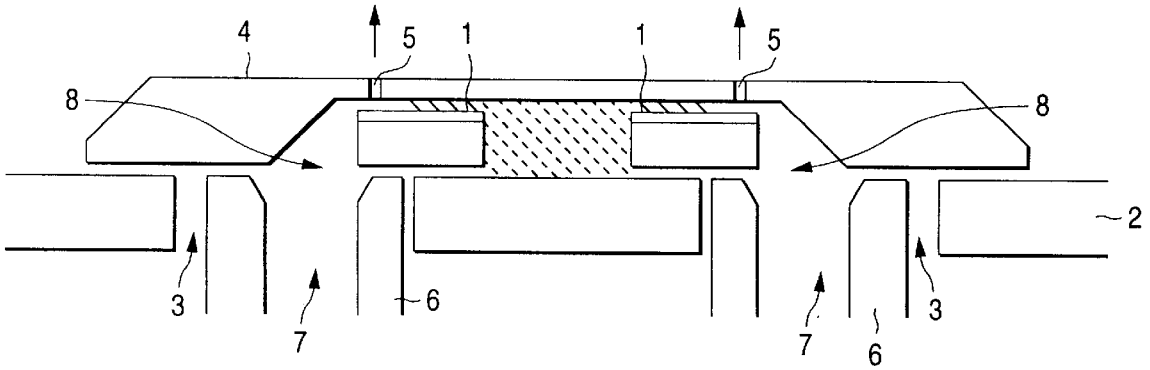
FIG. 19 is a section view of a fifth embodiment of an ink jet print head according to the invention.

Now, FIG. 19 is a section view of a fifth embodiment of an ink jet print head according to the invention. In the present embodiment, two structures, each of which has been already discussed in the above-mentioned first embodiment, are connected to each other in a right and left symmetrical manner. In particular, two openings 3 are formed in a heat sink 2 and two head chips 1 are interposed between the two openings 3. There are arranged a plurality of heating elements on either right or left side of the head chip 1. Also, in the fifth embodiment, a flow passage forming member 4 has a structure in which two flow passage forming members 4 each shown in the above-mentioned first embodiment are combined with each other in a right and left symmetrical manner. In this structure as well, similarly to the above-mentioned fourth embodiment, if the right and left heating elements are different in position from each other to thereby provide a cross-stitch arrangement, then there can be provided an ink jet print head having a resolution doubled what a normal arrangement has, or if the diameters of the injection ports 5 are changed, then there can be supplied an ink jet print head which is improved in gradation expression. Or, if mutually different inks are supplied to the right and left heating elements, then there can be produced a multi-color ink jet print head.

Figure 20:
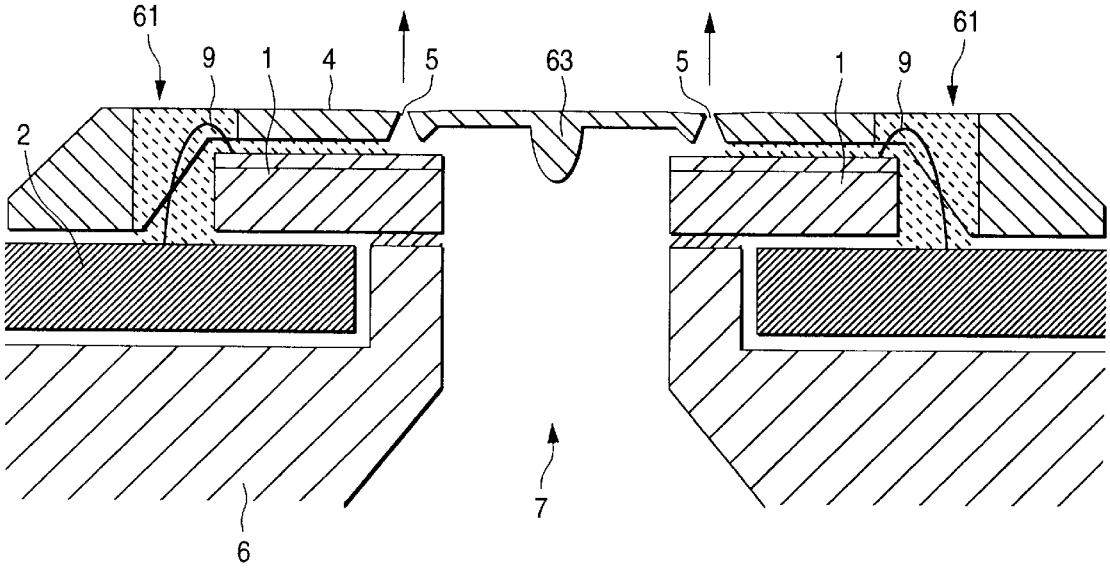
FIG. 20 is a section view of a sixth embodiment of an ink jet print head according to the invention.

Now, FIG. 20 is a section view of a sixth embodiment of an ink jet print head according to the invention. In FIG. 20, reference character 63 designates a projecting portion. In the sixth embodiment, there is disclosed a structure in which the directions of the head chips 1 shown in the above-mentioned fifth embodiment are inverted and the respective sides of the head chips 1 where the heating elements are arranged are thereby disposed opposed to each other. In the present embodiment, a common opening 3 is formed between the two head chips 1. And, a flow passage forming member 4 is disposed in such a manner that it covers the common opening 3 and two head chips 1.

In the flow passage forming member 4, there is provided a projecting portion 63 at a position which provides the central portion of the two head chips 1. Due to provision of this projecting portion 63, there are formed two right and left ink supply chambers 8. And, the projecting portion 63 also functions as the reinforcing portion of the flow passage forming member 4. In this structure, the electrical connection between the head chips 1 is executed on the thick side of the flow passage forming member 4. For this reason, according to the present embodiment, in the flow passage forming member 4, similarly to the above-mentioned third embodiment, there are formed a connecting portion openings 61 which respectively correspond to the electrically connecting portions of the head chips 1. Of course, these portions may not be formed as openings. In the sixth embodiment, when compared with the above-mentioned fourth and fifth embodiments, there is some room for the electrically connecting portion. In other words, in the fourth embodiment, the electrically connecting portion can be provided only on the lateral side and, in the fifth embodiment, all the wiring must be provided between the head chips 1. However, in the sixth embodiment, similarly to the previously described first embodiment, since pads for bonding. can be disposed on the opposite side to the heating elements, there is room for the pad arrangement pitch. Due to this, even if there are necessary a large number of pads to draw out the electrode in order to carry out a complicated processing, the sixth embodiment is able to cope with such case.

Here, since the section of the central portion of the ink jet print head is shown in FIG. 20, it seems that the joint 6 is connected only to the two head chips 1. However, in fact, in the two end portions of each of the head chips 1, the joint 6 is connected to the flow passage forming member 4, while the two head chips 1, flow passage forming member 4 and joint 6 are connected to each other to thereby form the flow passages for ink.

In the structure shown in FIG. 20, a common ink supply pipe 7 is connected to the two head chips 1. However, this is not limitative but, for example, if the ink supply pipe is separated by a wall to provide two ink supply pipes and the wall is connected to the flow passage forming member 4 at the position of the projecting portion 63, then different inks can be jetted out by the respective head chips 1. Of course, in the structure shown In FIG. 20, by changing the diameters of the injection ports 5 and the like, it is possible to attain multiple gradation. Also, if the heating elements of the right and left head chips 1 are displaced in position, then the dot resolution can be improved.

Figure 21A:
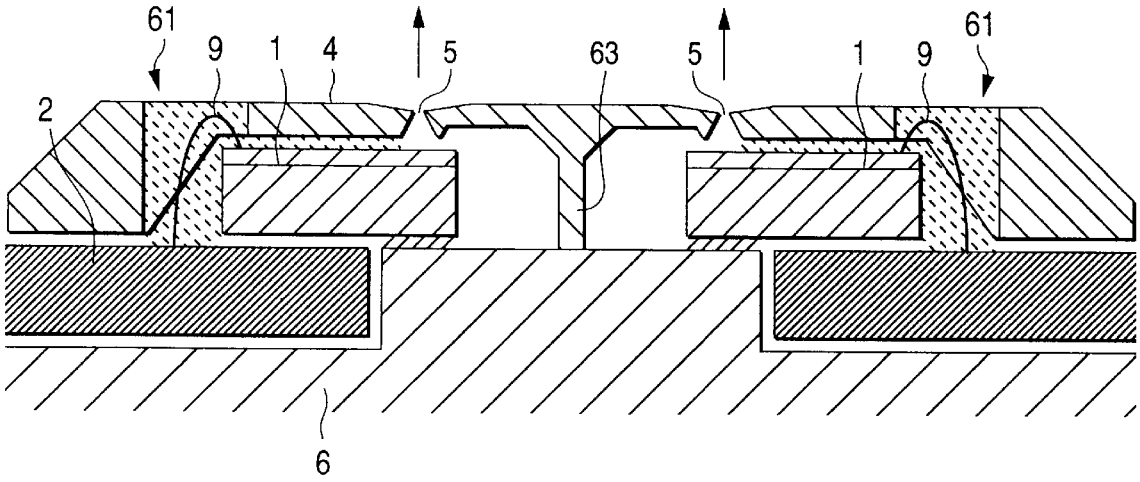
FIGS. 21A and 21B are a section view and a plan view of a modification of the sixth embodiment of an ink jet print head according to the invention.
Figure 21B:
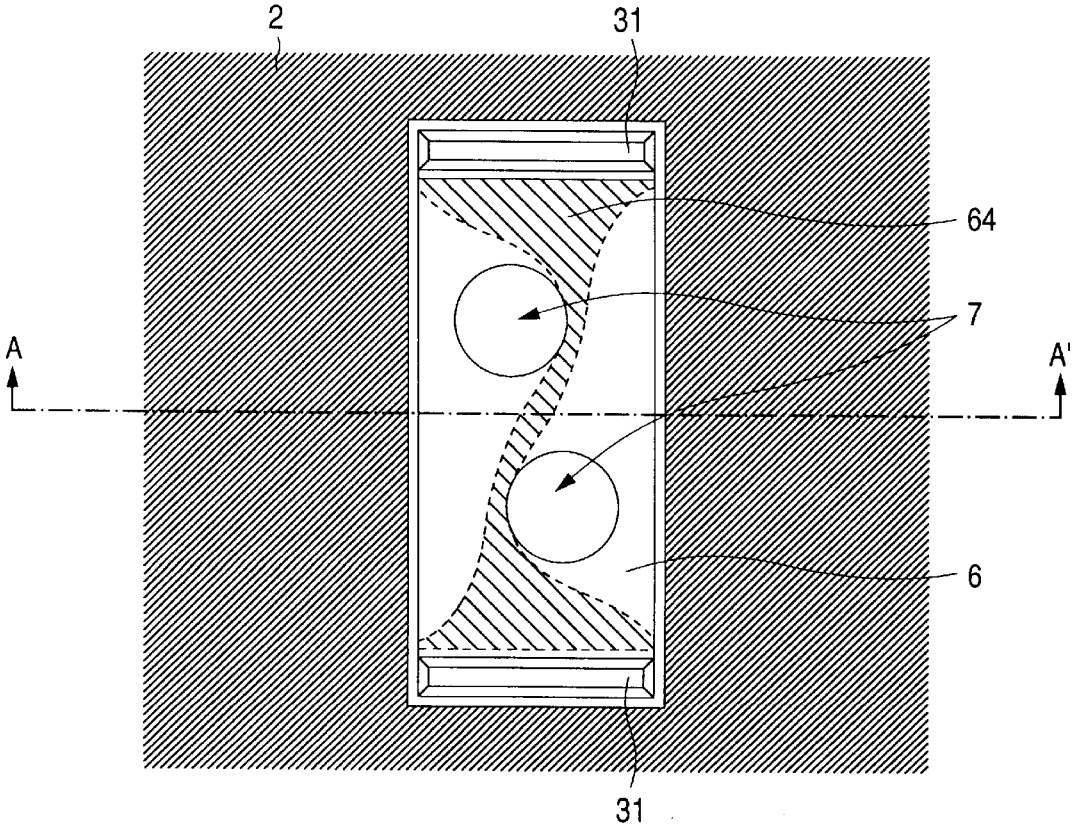

Now, FIG. 21 shows a section view and plan view of a modification of the sixth embodiment of an ink jet print head according to the invention. In these figures, reference character 64 designates a projecting portion connecting area. In particular, FIG. 21B is a plan view of the heat sink 2, while FIG. 21A is a section view taken along the line A–A' shown in FIG. 21B. In the present modification, in the structure shown in FIG. 20, the respective head chips 1 are allowed to jet out different inks therefrom. When supplying different inks, there is available a method in which there are arranged two ink supply pipes 7. In this method, in order to secure the flow rate of ink and to reduce the fluid resistance thereof, the ink supply pipes 7 must have a certain degree of cross section. Due to this, when the ink supply pipes 7 are arranged, the distance between the two head chips 1 is wide. Of course, this structure can be employed. Here, however, there is shown in FIG. 21 a structure in which the distance between the two head chips is narrower than the last-mentioned structure.

In the present modification, as shown in FIG. 21B, the two ink supply pipes 7 are disposed in such a manner that they are displaced in position in the arrangement direction of the heating elements. A projecting portion 63, which is provided in the flow passage forming member 4 and is used to form two ink supply chambers 8 respectively corresponding to their associated head chips 1, is formed in a curved line similar to an S character and, as shown in FIG. 21A, extends up to a position where it is contacted with the joint 6. The projecting portion connecting area 64, in which the projecting portion 63 is contacted with the joint 6, is shown FIG. 21B. Due to the fact that the projecting portion 63 is structured in this shape, the inks respectively supplied from the two ink supply pipes 7 can be made to flow smoothly, thereby being able to form the ink supply chambers 8 which are free from the stagnated air bubbles.

In the present modification, as shown in FIG. 21, the projecting portion 63 provided in the flow passage forming member 4 is extended but, as a further modification of the sixth embodiment, the projecting portion may be provided on the joint 6 side. Or, in correspondence to the projection portion, there may be formed a recessed portion in a component which is disposed on the side where the projecting portion is not provided, and the projecting portion and recessed portion may be fitted with each other. For example, a recessed portion may be formed in the projecting portion connecting area 64 shown in FIG. 21B and, after then, the recessed portion may be fitted with the projecting portion 63. If the projecting and recessed portions are structured such that they can be tightly fitted with each other, then a seal agent can be omitted. When using a seal agent, if the seal agent is applied to the recessed portion and the projecting portion is then inserted into the recessed portion, then the seal agent can be prevented from sticking out therefrom and thus the ink supply pipes 7 can be prevented from being clogged. And, the two ink supply chambers 8 can be positively separated from each other.

If the ink supply chambers 8 and ink supply pipes 7 are set too large in volume, then the ink flow rate is lowered down to thereby raise a possibility that the air bubbles and the like are easy to stagnate. For this reason, the volume of the ink supply chambers 8 and ink supply pipes 7 is limited. However, if they are structured in compliance with the dimensions thereof matched to such limits, then there is a possibility that, due to the dimensional limit, the ink supply pipes respectively for two different colors cannot be disposed in the arrangement direction of the head chips 1. In such case, as in the present modification, by disposing the ink supply pipes 7 in the arrangement direction of the heating elements which have room for dimensions, the optimum ink flow passages can be formed.

In the above-mentioned fourth to sixth embodiments, the two head chips 1 are used. As a method for using the two head chips 1, there is available a method for arranging two sets of the structures shown in the above-mentioned first to third embodiments as they are. In the above-mentioned fourth to sixth embodiments, the flow passage forming member 4 is used as a common part to thereby reduce the number of parts thereof. Of course, there can be used two or more sets of structures shown in the fourth to sixth embodiments. In a structure using two or more sets of structures shown in the first and second embodiments, or in a structure using one or more sets of structures shown in the third to sixth embodiments, as described above, if the respective lines of heating elements 17 are displaced in position with respect to each other, then the recording density can be enhanced, or different kinds of inks can be dealt with; and, if the diameters of the injection ports 5 and/or the size of the heating elements 17 are changed, then recording of multiple gradation is possible.

Figure 22A:
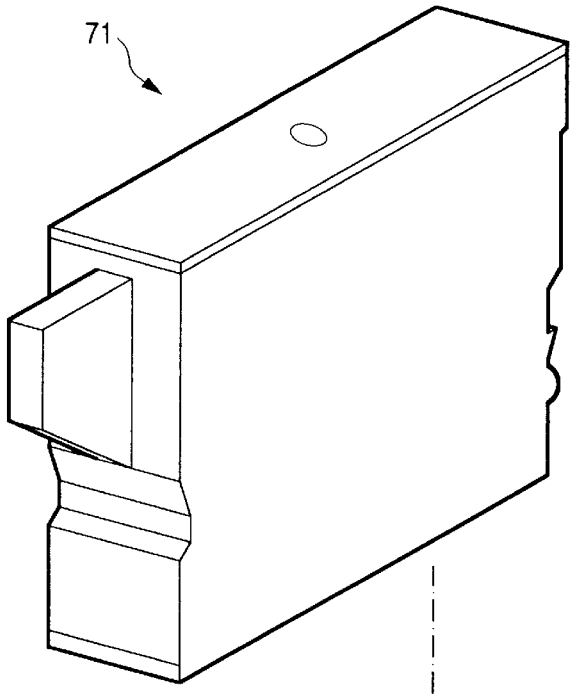
FIGS. 22A to 22C are perspective views of an example of a head unit incorporating therein an ink jet print head according to the invention.
Figure 22B:
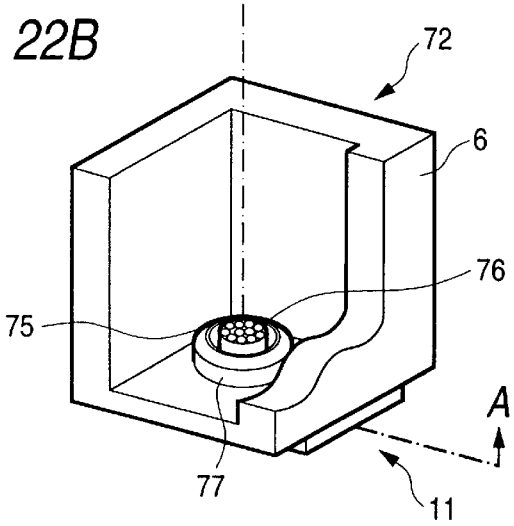
Figure 22C:
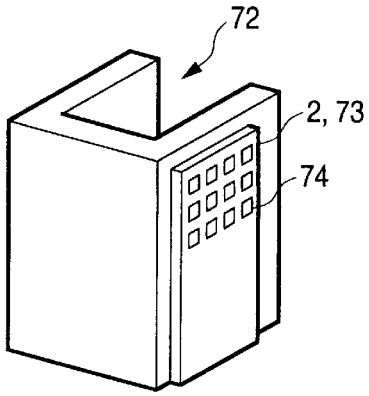
Figure 23:
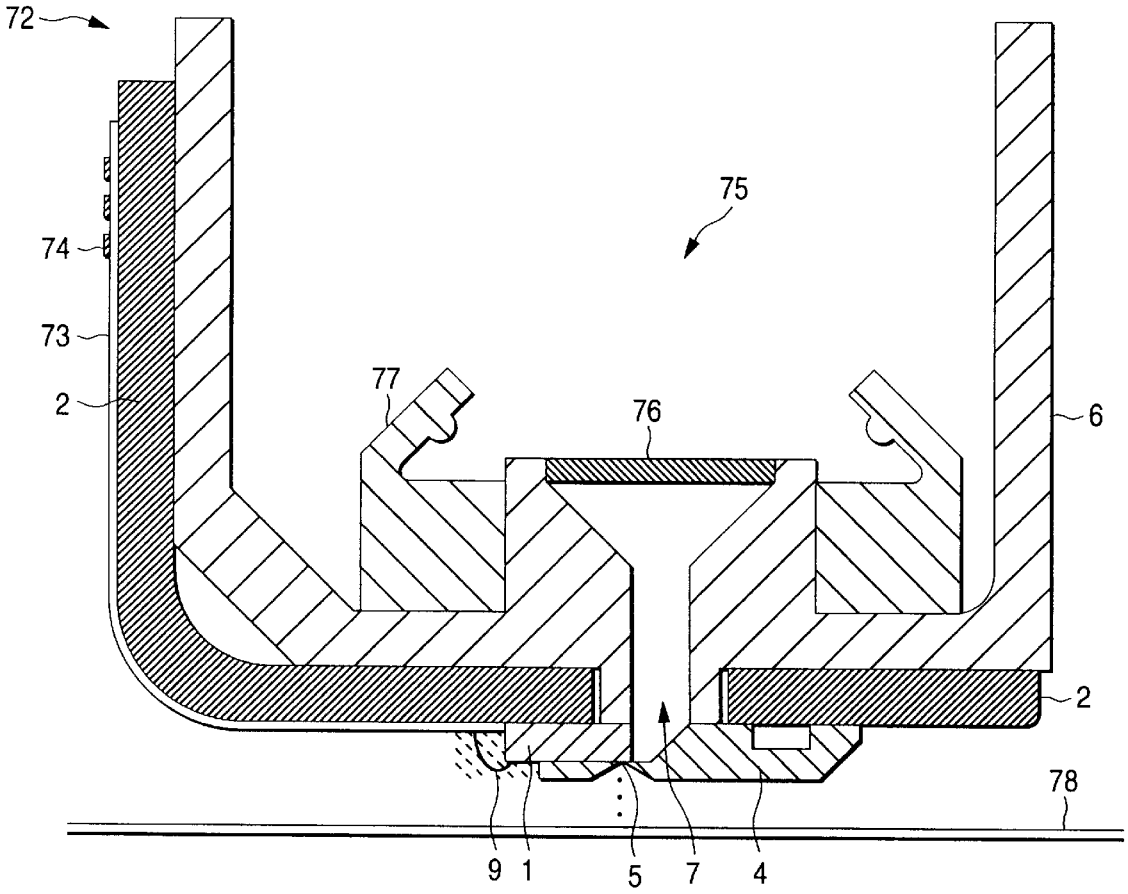
FIG. 23 is a section view of the example of a head unit incorporating therein an ink jet print head according to the invention; and, FIG. 24 is an outward appearance view of an example of an ink jet recording unit into which an ink jet print head and a head unit according to the invention are incorporated.

Now, FIG. 22 is a perspective view of an embodiment of a head unit incorporating therein an ink jet print head according to the invention, and FIG. 23 is a section view thereof. In these figures, reference character 71 designates an ink tank, 72 a head unit, 73 a flexible substrate, 74 a connector, 75 an ink introduction portion, 76 a filter, 77 a connecting member, and 78 a recording medium, respectively. Here, FIG. 23 shows the A section shown in FIG. 22B. In the present embodiment, there is shown a structure in which the ink tank 71 can be removably mounted. Also, as an ink jet print head, here, there is employed an ink jet print head having a structure shown in FIG. 1 and, in FIG. 23, there is shown an ink jet print head having a structure which is a 180° rotated version of the structure shown in FIG. 1. Of course, a similar effect can be provided even if any ink jet print head having any one of other structures than the above-mentioned structures is used.

In the head unit 72, there is formed the ink introduction portion 75 which is used to allow the ink tank 71 and ink to be in liquid communication with each other, while the introduction portion 75 is fixed to a carriage (not shown) provided in an ink jet recording unit. Of course, the head unit 72 can also be structured so that it can be mounted and removed.

In the ink introduction portion 75, there is provided the connecting member 77 which is used to close tightly an ink flow passage between the ink tank 71 and the ink introduction portion 75. The present connecting member 77 is formed of elastic material such as rubber or the like and, when the ink tank 71 is mounted, the leading end of the connecting member 77 can be contacted with and deformed by the bottom surface of the ink tank 71 to thereby be able to close tightly the ink introduction portion 75. Also, in the ink introduction portion 75, there is provided the filter 76 which is used to trap dust and air bubbles going to flow into the ink introduction portion 75 from the ink tank 71 or the dust and the like that come flying after the ink tank 71 is removed, thereby preventing them from invading into the ink supply pipes 7. The filter 76 further has a function which, when the ink tank 71 is removed, causes ink meniscus to be generated, thereby preventing the ink from leaking out from the ink jet print head.

The box body of the head unit 72 serves also as the joint 6. As shown in FIGS. 23 and 22C, one side of the heat sink 2 is folded and is thereby extended up to the side surface of the head unit 72. As shown in FIG. 1, the head chip 1 and flow passage forming member 4 are mounted on the heat sink 2. Also, on the heat sink 2, there is provided the flexible substrate 73 which is used to achieve electrical connection, while one end of the flexible substrate 73 is electrically connected with the head chip 1 by means of the bonding wire 9 or the like. Also, the other end of the flexible substrate 73, similarly to the heat sink 2 folded up to the side surface of the head unit 72, is extended up to the side surface of the head unit 72 and, in the thus extended portion of the flexible substrate 73, there is provided the connector 74 which is used to electrically connect the flexible substrate 73 with the main body of the ink jet recording unit. Electric power to drive the head chip 1 to jet out ink can be supplied through the present connector 74. Also, image signals, control signals and the like can be transmitted and received through the present connector 74.

As can be seen from FIGS. 23 as well, the distance between the heat sink 2 and recording medium 78 is very small and, therefore, it is difficult to electrically connect the heat sink 2 with the ink jet recording unit main body in this narrow space. However, as in the present invention, if the electric connection with the ink jet recording unit main body is achieved by means of the folded portion, then the head unit 72 carrying an ink jet print head of a roof shooter type thereon can be manufactured in a simple structure and at low costs. Also, provision of the head chip 1 on the heat sink 2 can stabilize the heat radiation property as well as can provide a sufficient strength. Further, since the heat sink 2 is prevented from being contacted with ink, the heat sink 2 is free from corrosion due to ink and is excellent in durability.

In FIGS. 22 and 23, there is shown a structure in which the head unit 72 and ink tank 71 can be separated from each other. However, this is not limitative but the head unit 72 can be formed integrally with the ink tank 71. In this case, the joint 6 can be structured such that it also serves as the box body of the ink tank or as part of the present box body. Even in this structure, one side of the heat sink 2 may be folded and extended up to the side surface of the ink tank, and the connector may be disposed in the thus folded and extended portion.

Also, on the head unit 72, there can be disposed two or more of the above-mentioned ink jet print heads. Due to the fact that the head chip 1 is disposed on the heat sink 2, the present invention is advantageous especially when the length thereof is extended. Also, when the length thereof is extended, for example, the head chip 1 can also be divided to sub-sections. Further, if the injection ports 5 provided in two or more head chips 1 are displaced in position, then the resolution can be enhanced, or if the diameters of the injection ports 5 are changed, then it is also possible to provide an ink jet recording unit which is capable of gradation recording.

In FIGS. 22 and 23, there is shown a structure which includes only one ink introduction portion 75. However, for example, when different kinds of inks are used, a plurality of ink introduction portions may be provided in the head unit 72. For instance, when using an ink jet print head having a structure according to the second embodiment shown in FIG. 13, since three colors of inks can be used, three ink introduction portions may be provided. In this case, the ink tank 71 may be structured such that the three color inks can be integrally stored therein, or that three ink tanks can be removably mounted. In the case of the ink tank of a three color ink integral type, it may be structured integrally with the ink jet print head. Also, out of the structures respectively shown in the fourth to sixth embodiments, in the structure(s) capable of dealing with different kinds of inks, two ink Introduction portions may be provided. Further, a plurality of such ink jet print heads can also be provided in the head unit 72 and, in that case as well, a corresponding number of ink introduction portions may be provided.

Figure 24:
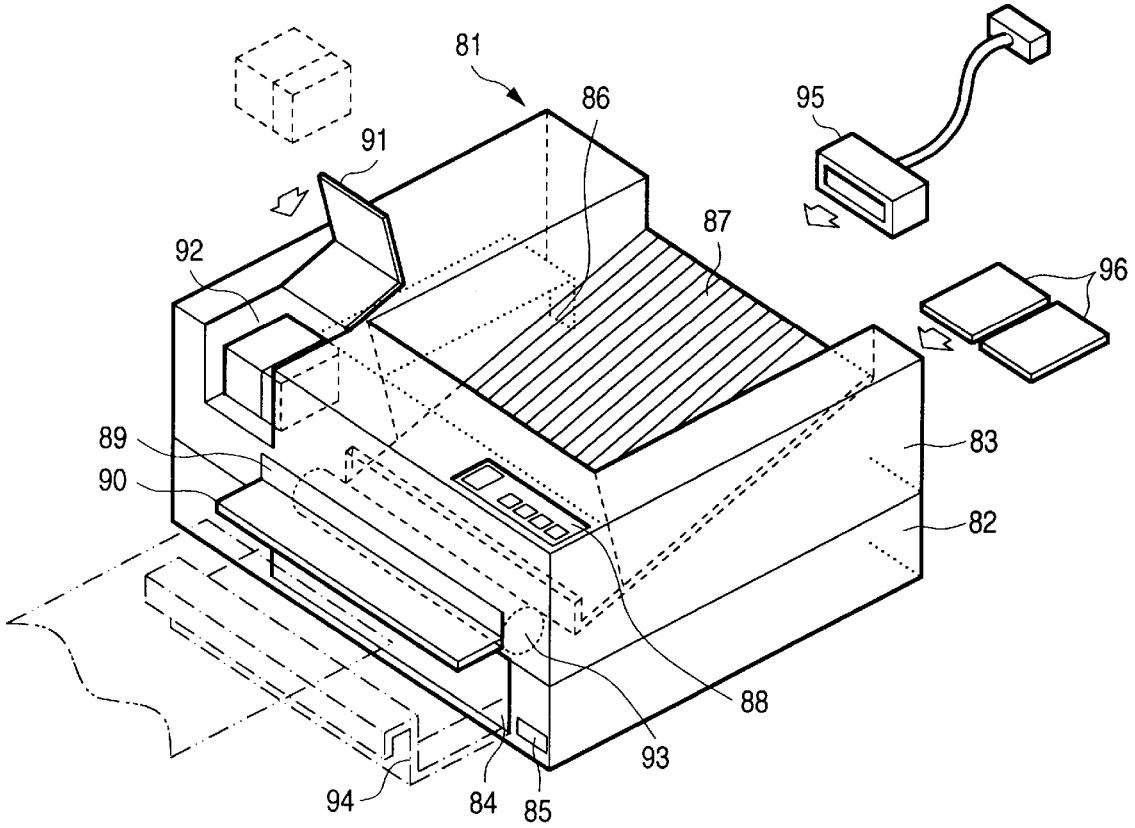

Now, FIG. 24 is an outward appearance view of an ink jet recording unit into which an ink jet print head and a head unit according to the invention are mounted. In FIG. 24, reference character 81 designates a recording unit, 82 a lower case, 83 an upper case, 84 a tray insertion opening, 85 a dip switch, 86 a main switch, 87 a sheet receiver, 88 a panel console, 89 a manual insertion opening, 90 a manual tray, 91 an ink tank insertion cover, 92 an ink tank, 93 a sheet feed roller, 94 a sheet tray, 95 an interface cable, and 96 a memory card, respectively.

The box body of the recording unit 81 consists mainly of the lower case 82 and upper case 83. An electric circuit (not shown), drive system parts (not shown) and the like are stored in the box body of the recording unit 81. In the lower case 82, there is formed the tray insertion opening 84. The sheet tray 94, in which sheets for recording are stored, can be inserted through the tray insertion opening 84 so that the sheets can be loaded into the recording unit 81.

Also, on the lower case 82, there are mounted the dip switch 85 and main switch 86. The dip switch 85 is used to set part of the operation of the recording unit 81 and thus a function to set the operations that are changed less frequently is allocated to the dip switch 85. This dip switch 85 is structured such that, when not in use, it is covered with a cover. And, the main switch 86 is used to turn on or off the power source of the recording unit 81. In the lower case 82, there is further formed an insertion opening for insertion of an interface connector (not shown), the memory card 86 and the like. The interface cable 95 is connected to the interface connector so that data can be exchanged between the recording unit and an external computer or the like. The memory card 96 can be used as an expansion memory when the recording unit 81 is in operation, or, in some cases, fonts can be stored in the memory card 96 so that the fonts can be used in recording.

On the other hand, in the upper case 83, there is provided the sheet receiver 87 through which recorded sheets can be discharged out. Also, the upper case 83 includes the panel console 88 in which there are arranged input means to be used frequently by a user, such as setting of a recording mode, instruction of sheet feed, sheet discharge and the like, and display means for displaying messages from the recording unit side. Further, in the upper case 83, there are provided the manual insertion opening 89 and manual tray 90 through which sheets can be fed manually by the user.

Moreover, the upper case 83 includes the ink tank insertion cover 91. By opening this cover 91, the ink tank 92 disposed in the interior of the upper case 83 can be removed and mounted. Here, there are shown a rather large-sized ink tank of a three color integral type and a rather small-sized ink tank of a single color type, while they can be mounted individually. The ink tank 92 is mounted to a head unit (not shown). Here, in correspondence to the two ink tanks, there are provided first and second head units. For example, the first head unit, to which the ink tank of a single color type is mounted, can be structured as shown in the above-mentioned FIGS. 22 and 23. In the present embodiment, in addition to the first head unit, there is provided the second head unit which includes three ink introduction portions, and the ink tank of a three color integral type is mounted to the second head unit. As the second head unit, there is used a head unit which mounts thereon an ink jet print head capable of using three color inks, for example, the ink jet print head illustrated in the above-mentioned second embodiment. The first and second head units are respectively fixed to a carriage (not shown), or they are removably mounted on the carriage.

When four color inks are used, for example, two of the ink jet print heads illustrated in the above-mentioned fourth to sixth embodiments may be used to thereby be able to realize the four color recording. Also, in order to be able to carry out gradation recording separately from the color recording or together with the color recording, there can be employed a structure which includes a large number of ink jet print heads.

Sheets stored in the sheet tray 94 are taken out and delivered one by one by a delivery system (not shown) provided in the interior of the recording unit, or sheets are manually inserted one by one through the manual insertion opening 89. After then, the sheet is fed along the circumference of the sheet feed roller. A record head (not shown) with the ink tank 92 mounted thereon is moved in a direction at right angles to the feeding direction of the sheet to carry out recording in every belt-shaped area. And, the sheet is fed up to the recording position of the next belt-shaped area by the sheet feed roller 93. By carrying out this operation repeatedly, the recording can be executed on the sheet. After then, the recorded sheet is discharged into the sheet receiver 87 of the upper case 83.

Here, the ink jet recording unit shown in FIG. 24 is just an example. That is, another embodiment can also be employed, provided that it includes one or more ink jet print heads or head units according to the invention.

As can be clearly understood from the foregoing description, according to the invention, there can be provided an ink jet print head of a roof shooter type which has an excellent injection characteristic as well as a high resolution. Also, due to the reduced number of parts and simplified manufacturing process, the invention can supply an ink jet print head which is inexpensive and is stable in quality. Further, since the strength of the part including the injection ports in secured, there is reduced the possibility that the present print head can be broken or damaged, thereby being able to enhance the yield rate thereof. Still further, because the injection port surface is composed of a recess having a gentle slope, the present print head is excellent in the wiping characteristic thereof as well as is improved in the ink jetting property thereof. Yet further, due to the direct sealing between the joint, flow passage forming member and head chip, ink is prevented from adhering to the heat sink, which eliminates the possibility that the heat sink can be corroded due to the ink. Moreover, since there is employed a structure in which a heat sink formed of metal or the like is used and the head chip is mounted on the heat sink, the structure is excellent in strength as well as in heat radiation property, which makes it possible to provide an ink jet print head having a stabilized ink property.

What is claimed is:

1. An ink jet print head comprising:

a head chip having a plurality of heating elements thereon, a flow passage forming member including a plurality of injection ports respectively corresponding to said heating elements for jetting out ink, a substrate for fixing said head chip, and a joint for supplying ink, wherein said substrate includes an opening so formed as to extend in the arrangement direction of said heating elements, said flow passage forming member is disposed so as to cover said opening from a position above said head chip, at least part of said joint is connected to said flow passage forming member, and ink supplied from said joint is supplied along said flow passage forming member to said heating elements disposed on said head chip.

2. The ink jet print head of claim 1, wherein said substrate is a heat sink formed of a highly thermally conductive material.

3. The ink jet print head of claim 2, wherein said head chip is thermally connected to said substrate.

4. The ink jet print head of claim 2, wherein said joint is connected to part of said head chip, and a tightly closed flow passage is formed due to the connection of said joint to said head chip as well as due to the connection thereof to said flow passage forming member.

5. The ink jet print head of claim 4, wherein the side wall of an ink supply pipe disposed in said joint and the side surface of said head chip are formed substantially in a straight line.

6. The ink jet print head of claim 4, wherein, in the positions of said joint that respectively correspond to the two sides of said head chip, there are provided either projections or projection receive portions for receiving said projections, and said projection receive portions or said projections are provided in said flow passage forming member, while the two end portions of said head chip are sealed by means of said projections and said projection receive portions.

7. The ink jet print head of claim 1, wherein only part of said head chip is connected to said substrate.

8. The ink jet print head of claim 1, wherein said flow passage forming member is formed such that the thickness of the portion thereof situated above said head chip is different from the thickness of the other portions thereof.

9. The ink jet print head of claim 1, wherein said flow passage forming member is formed to have a slope in such a manner that the thickness thereof increases gradually from the portion thereof situated in the neighborhood of the end portion of said head chip over to the connecting portion thereof with said joint.

10. The ink jet print head of claim 1, wherein said flow passage forming member, the end face of said head chip, and said joint cooperate in forming an ink supply chamber which extends in the arrangement direction of said heating elements and is used in common to two or more of said heating elements.

11. The ink jet print head of claim 10, wherein, said ink supply chamber includes, in the portion of said flow passage forming member that is situated in the neighborhood of the end portion of said head chip, a recessed portion which is so formed as to extend in the arrangement direction of said heating elements.

12. The ink jet print head of claim 10, wherein said ink supply chamber is narrowed down on the two sides thereof.

13. The ink jet print head of claim 10, wherein said flow passage forming member includes individual flow passages which respectively correspond to said heating elements, said individual flow passages respectively communicate with not only said injection ports but also said ink supply chamber, and each of said individual flow passages includes a narrowing portion which projects in the opposite direction to the jetting direction of ink and narrows down said individual flow passage.

14. The ink jet print head of claim 1, wherein said flow passage forming member includes a recessed portion which is formed in the injection port surface where said injection port is open.

15. The ink jet print head of claim 14, wherein said recessed portion formed in said injection port surface is formed such that the slope thereof on the side where said flow passage forming member extends from said head chip is steeper in inclination than the slope thereof on the opposite side.

16. The ink jet print head of claim 1, wherein said flow passage forming member extends up to said substrate situated on the opposite side to the ink supply side of said head chip.

17. The ink jet print head of claim 16, wherein said flow passage forming member includes one or more openings which correspond to the electrically connecting portion of said head chip.

18. The ink jet print head of claim 1, wherein said substrate is in part folded and the electrically connecting portion of said substrate with a recording unit main body is disposed in said folded portion.

19. The ink jet recording unit comprising:

a plurality of ink jet print heads of claim 1.

20. An ink jet print head comprising:

a head chip having a plurality of heating elements thereon, a flow passage forming member including a plurality of injection ports respectively corresponding to said heating elements for jetting out ink, a substrate for fixing said head chip, and a joint for supplying ink, wherein said head chip is disposed in the exposed portion of the end face of said substrate in such a manner that the extending direction of said heating elements, said flow passage forming member extends from the upper portion of said head chip at least up to an area where said head chip and said substrate are not present, at least part of said joint is connected to said flow passage forming member, ink is supplied from said joint in said area, and said ink is supplied along said flow passage forming member to said heating elements disposed on said headchip.

21. An ink jet print head comprising:

a head chip having a plurality of heating elements thereon, a flow passage forming member including a plurality of injection ports respectively corresponding to said heating elements for jetting out ink and a plurality of individual flow passages respectively in communication with said injection ports, a substrate for fixing said head chip, and a joint for supplying ink, wherein said substrate includes an opening so formed as to extend in the arrangement direction of said heating elements, said flow passage forming member is disposed so as to cover said opening from a position above said head chip, at least part of said joint is connected to said flow passage forming member, and each of said individual flow passages is formed in such a manner that, in the portion of said individual flow passage that is situated above said heating element, the cross section thereof is reduced toward said injection port.

22. The ink jet print head of claim 21, wherein each of said heating element is formed in a rectangular shape which has long sides extending at right angles to the arrangement direction of said heating elements, and the end portion of said heating element is located below the portion or said individual flow passage where the cross section of said individual flow passage is reduced toward said injection port.

23. The ink jet print head of claim 21, wherein said individual flow passage includes a narrowing portion which projects in the opposite direction to the jetting direction of ink and narrows down said individual flow passage, the side surface of said narrowing portion on the side of said heating element as well as the side surface thereof opposed to said side surface are formed as slopes so that the cross section of said individual flow passage is reduced gradually toward said injection port, and the portion of said narrowing portion on said ink supply chamber side is formed as a flow passage which is deep in the thickness direction of said flow passage forming member.

24. The ink jet print head of claim 21, wherein a partition for separating said individual flow passages from each other extends up to said ink supply chamber side.

25. The ink jet print head of claim 21, wherein, on said head chip, there is a provided a protection layer except for at least the heating area of said heating elements, and the width of said protection layer to be contacted with said partition for separating said individual flow passage is greater than the width of the contact portion of said individual flow passage.

26. The ink jet print head of claim 21, wherein the volume V of said individual flow passage from said heating element to said injection port satisfies the following condition:

$$V \geq \pi\left(p/\sqrt{2}\right)^3/48,$$

where p expresses the pitch of a dot to be recorded.

27. The ink jet print head of claim 21, wherein said individual flow passage is structured such that, in the portion thereof situated above said heating element, the wall surface thereof on said ink supply chamber side and the wall surface thereof on the opposite side of said wall surface are respectively formed as slopes, and said ink supply chamber is structured such that the wall thereof facing the connecting portion thereof with said individual flow passage is inclined.

28. The ink jet print head of claim 21, wherein the neighborhood of said injection port has a shape which narrows down toward said injection port and thus forms a two-stage narrowing structure together with the slope of said individual flow passage.

29. An ink jet print head comprising:

a head chip having thereon a plurality of heating elements arranged in two lines, a flow passage forming member including a plurality of injection ports so formed as to correspond to said heating elements for jetting out-ink, a substrate for fixing said head chip, and a joint for supplying ink, wherein said substrate includes, on the two sides thereof near to said head chip, openings respectively so formed as to extend in the arrangement direction of said heating elements, said flow passage forming member is disposed so as to cover said head chip and said openings, said joint is connected to said now passage forming member and said head chip for each of said openings to form flow passages for ink, and a ink supplied from said joint is supplied along said flow passage forming member from the side surface of said head chip to said heating elements arranged on said head chip.

30. The ink jet print head of claim 29, wherein said flow passage forming member includes an opening in the portion thereof corresponding to the side end of said head chip that does not provide said ink flow passage.

31. An ink jet print head comprising:

a plurality of head chips each having a plurality of heating elements thereon, a flow passage forming member including a plurality of injection ports respectively so formed as to correspond to said heating elements for jetting out ink, a substrate for fixing said head chips, and a joint for supplying ink, wherein said substrate includes openings which are respectively so formed as to extend in the arrangement direction of said heating elements and also correspond to said head chips, said flow passage forming member is disposed so as to cover said head chips and said openings, said joint is connected to said flow passage forming member and said head chips for each of said openings, and ink supplied from said joint is supplied along said flow passage forming member to said heating elements disposed on said head chips.

32. An ink jet print head comprising:

a plurality of head chips each having a plurality of heating elements thereon, a flow passage forming member including a plurality of injection ports respectively so formed as to correspond to said heating elements for jetting out ink, substrate for fixing said head chips, and a joint for supplying ink, wherein said substrate includes an opening so formed as to extend in the arrangement direction of said heating elements, said head chips are disposed with said opening between them in such a manner that the sides of said head chips where said heating elements are arranged are opposed to each other, said flow passage forming member is disposed so as to cover said head chips and said opening, said joint is connected to said flow passage forming member and said head chips, and ink supplied from said joint is fed along said flow passage forming member to said heating elements disposed on said head chips.

33. The ink jet print head of claim 32, wherein said flow passage forming member includes a projecting portion provided substantially in the central portion thereof between said head chips.

34. The ink jet print head of claim 32, wherein said joint includes a plurality of ink supply pipes respectively corresponding to said head chips, said flow passage forming member or said joint includes a projecting portion for separating the flow passages of said head chips from each other, and said projecting portion is connected to said joint or said flow passage forming member to form ink flow passages which respectively correspond to said ink supply pipes.

35. The ink jet print head of claim 34, wherein said ink supply pipes are respectively disposed at positions which are displaced in the arrangement direction of said heating elements.

36. A method for manufacturing an ink jet print head comprising the steps of:

fixing a head chip having thereon a plurality of heating elements onto a substrate including an opening so formed as to extend in the arrangement direction of said heating elements;

positioning a flow passage forming member including a plurality of injection ports so formed as to correspond to said heating element for jetting out ink with respect to said head chip;

connecting said flow passage forming member to said head chip in such a manner that said flow passage forming member covers said opening; and inserting a joint for supplying ink into said opening to seal at least between said flow passage forming member and said joint.

37. The method for manufacturing an ink jet print head of claim 36, wherein, in forming said flow passage forming member, the outer shape thereof and at least individual flow passages respectively corresponding to said heating elements are firstly formed by molding and, after then, said injection ports are formed by laser machining.

38. A method for manufacturing an ink jet print head comprising the steps of:

with respect to a head chip having a plurality of heating elements thereon;

positioning a flow passage forming member including a plurality of injection ports so formed as to correspond to said heating element for jetting out ink;

connecting said flow passage forming member to said head chip;

connecting the connected body of said head chip and said flow passage forming member onto a substrate including an opening so formed as to extend in the arrangement direction of said heating elements in such a manner that said connected body covers said opening; and inserting a joint for supplying ink into said opening to seal at least between said flow passage forming member and said joint.

39. The method for manufacturing an ink jet print head of claim 38, wherein, in forming said flow passage forming member, the outer shape thereof and at least individual flow passages respectively corresponding to said heating elements are firstly formed by molding and, after then, said injection ports are formed by laser machining.

40. The method for manufacturing an ink jet print head of claim 38, wherein, in forming said flow passage forming member, the flow passages thereof each including an air bubble growth chamber permitting the growth of air bubbles generated when ink is heated by said heating elements are firstly formed, said injection ports are then opened and formed by laser machining, said injection ports are made to correspond in position to said heating elements of said head chip, and said head chip is connected to said flow passage forming member.

* * * * *